US009213282B2

(12) United States Patent
Okabayashi et al.

(10) Patent No.: US 9,213,282 B2
(45) Date of Patent: Dec. 15, 2015

(54) FIXING DEVICE AND IMAGE FORMING APPARATUS

(71) Applicant: FUJI XEROX CO., LTD., Tokyo (JP)

(72) Inventors: Yasuto Okabayashi, Kanagawa (JP); Masataka Konishi, Kanagawa (JP); Atsumi Kurita, Kanagawa (JP); Akihiro Iizuka, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 24 days.

(21) Appl. No.: 13/850,764

(22) Filed: Mar. 26, 2013

(65) Prior Publication Data

US 2014/0064803 A1 Mar. 6, 2014

(30) Foreign Application Priority Data

Sep. 4, 2012 (JP) ..... 2012-194451

(51) Int. Cl.
*G03G 15/20* (2006.01)

(52) U.S. Cl.
CPC .... *G03G 15/2064* (2013.01); *G03G 2215/2038* (2013.01)

(58) Field of Classification Search
CPC ..... G03G 2215/2035; G03G 2215/2038
USPC ..... 399/329
See application file for complete search history.

(56) References Cited

U.S. PATENT DOCUMENTS 5,091,752 A * 2/1992 Okada ..... 399/329
5,262,834 A * 11/1993 Kusaka et al. ..... 399/329
5,355,204 A * 10/1994 Aoki ..... 399/329
5,499,087 A * 3/1996 Hiraoka et al. ..... 399/329
5,621,510 A * 4/1997 Okuda et al. ..... 399/338
5,852,763 A * 12/1998 Okuda et al. ..... 399/329
5,999,788 A * 12/1999 Kanesawa et al. ..... 399/329
6,026,273 A * 2/2000 Kinouchi et al. ..... 399/328
6,035,155 A * 3/2000 Kaji et al. ..... 399/69
7,242,898 B2 * 7/2007 Kawahata ..... 399/329
2003/0224192 A1 12/2003 Tani et al.
2004/0234290 A1 11/2004 Tomatsu
2005/0047838 A1 * 3/2005 Uehara et al. ..... 399/329
2005/0142478 A1 6/2005 Matsumura et al.

(Continued)

FOREIGN PATENT DOCUMENTS

JP A-2002-31921 1/2002
JP A-2004-279702 10/2004
JP A-2010-145620 7/2010

OTHER PUBLICATIONS

Jun. 25, 2014 Office Action issued in Australian Patent Application No. 2013205405.

*Primary Examiner* — David Bolduc
(74) *Attorney, Agent, or Firm* — Oliff PLC

(57) ABSTRACT

A fixing device includes a fixing rotary body that heats and pressurizes, together with a recording medium, toner having particle diameter of 4.5 [μm] or less and a softening point of 100 [° C.] or higher and 125 [° C.] or lower to fix the toner on the recording medium, a heating unit that heats the fixing rotary body, and a pressurizing unit that sandwiches and pressurizes the toner and the recording medium in a contact part formed by the fixing rotary body, wherein the maximum pressure in the contact part is equal to or more than $2.9\times10^5$ [Pa], the width of the contact part in a movement direction of the recording medium is equal to or more than 10 [mm], and the heating time of the toner in the contact part is equal to or more than 20 [msec].

4 Claims, 13 Drawing Sheets

(56) References Cited

U.S. PATENT DOCUMENTS

| | | | | |
|---|---|---|---|---|
| 2007/0025750 | A1* | 2/2007 | Ando | 399/67 |
| 2007/0048042 | A1* | 3/2007 | Uehara et al. | 399/329 |
| 2007/0166084 | A1* | 7/2007 | Yoshino et al. | 399/329 |
| 2008/0102393 | A1* | 5/2008 | Hasegawa | 430/109.3 |
| 2008/0102395 | A1* | 5/2008 | Ohmura et al. | 430/109.4 |
| 2008/0112738 | A1* | 5/2008 | Yoshino et al. | 399/329 |
| 2008/0118855 | A1* | 5/2008 | Nakayama et al. | 430/109.4 |
| 2008/0152404 | A1* | 6/2008 | Yoshino et al. | 399/329 |
| 2008/0159777 | A1* | 7/2008 | Fuwa et al. | 399/107 |
| 2008/0280218 | A1* | 11/2008 | Sabu et al. | 430/48 |
| 2008/0304882 | A1* | 12/2008 | Shin et al. | 399/329 |
| 2009/0180820 | A1* | 7/2009 | Tsai et al. | 399/329 |
| 2009/0214974 | A1* | 8/2009 | Kouyama et al. | 430/108.21 |
| 2009/0239164 | A1* | 9/2009 | Kouyama et al. | 430/42.1 |
| 2009/0239168 | A1* | 9/2009 | Kouyama et al. | 430/107.1 |
| 2009/0246656 | A1* | 10/2009 | Kouyama et al. | 430/45.5 |
| 2010/0233604 | A1 | 9/2010 | Maehata et al. | |
| 2011/0135341 | A1* | 6/2011 | Kamiya et al. | 399/122 |
| 2011/0212396 | A1* | 9/2011 | Farrugia et al. | 430/108.4 |
| 2011/0236813 | A1* | 9/2011 | Kiyono et al. | 430/105 |
| 2011/0305473 | A1* | 12/2011 | Tamaki | 399/67 |
| 2013/0243501 | A1* | 9/2013 | Chiba | 399/329 |
| 2013/0251419 | A1* | 9/2013 | Kimura et al. | 399/329 |
| 2013/0272758 | A1* | 10/2013 | Hayashi et al. | 399/329 |
| 2014/0056627 | A1* | 2/2014 | Okabayashi et al. | 399/330 |

* cited by examiner

COMPARATIVE EXAMPLE

PRESENT EMBODIMENT

FIXING DEVICE AND IMAGE FORMING APPARATUS

CROSS-REFERENCE TO RELATED APPLICATIONS

This application is based on and claims priority under 35 USC 119 from Japanese Patent Application No. 2012-194451 filed Sep. 4, 2012.

BACKGROUND

Technical Field

The present invention relates to a fixing device and an image forming apparatus.

SUMMARY

According to an aspect of the invention, there is provided a fixing device including a fixing rotary body that heats and pressurizes, together with a recording medium, toner having particle diameter of 4.5 [μm] or less and a softening point of 100 [° C.] or higher and 125 [° C.] or lower to fix the toner on the recording medium; a heating unit that heats the fixing rotary body; and a pressurizing unit that sandwiches and pressurizes the toner and the recording medium in a contact part formed by the fixing rotary body, wherein the maximum pressure in the contact part is equal to or more than $2.9\times10^5$ [Pa], the width of the contact part in a movement direction of the recording medium is equal to or more than 10 [mm], and the heating time of the toner in the contact part is equal to or more than 20 [msec].

BRIEF DESCRIPTION OF THE DRAWINGS

Exemplary embodiments of the present invention will be described in detail based on the following figures, wherein.

DETAILED DESCRIPTION

First Exemplary Embodiment

Figure 1:
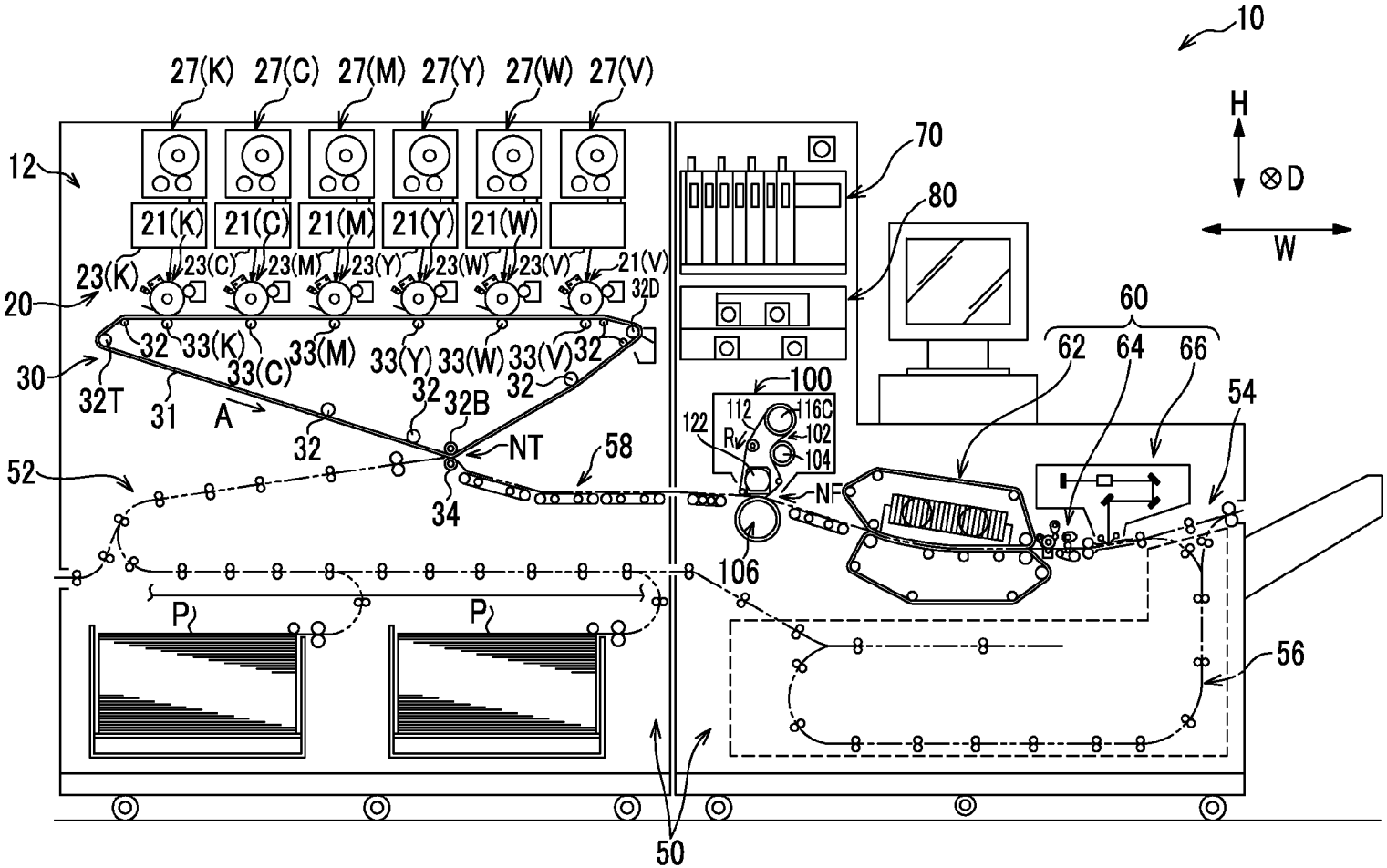
FIG. 1 is a schematic view showing the overall configuration of an image forming apparatus related to a first exemplary embodiment.

An example of a first exemplary embodiment of the invention will be described below with reference to the drawings. The overall configuration and operation of an image forming apparatus will first be described, and the configuration and operation of a fixing device that is a main part of the first exemplary embodiment will next be described. In addition, in the following description, a direction shown by arrow H in FIG. 1 is defined as an apparatus height direction, and a direction shown by arrow W in FIG. 1 is defined as an apparatus width direction. Additionally, a direction (shown by D) orthogonal to the apparatus height direction and the apparatus width direction, respectively, is defined as an apparatus depth direction.

Overall Configuration of Image Forming Apparatus

As shown in FIG. 1, the image forming apparatus 10 is configured to include an image forming section 12 that forms an image on recording paper P as an example of a recording medium by an electrophotographic method, a medium transporting section 50 that transports the recording paper P, and a post-processing section 60 that performs post-processing or the like to the recording paper P on which an image is formed. Moreover, the image forming apparatus 10 is configured to include a controller 70 that performs control of the above respective sections, and a power source section 80 that supplies electric power to the above respective sections including the controller 70.

Configuration of Image Forming Section

Figure 2:
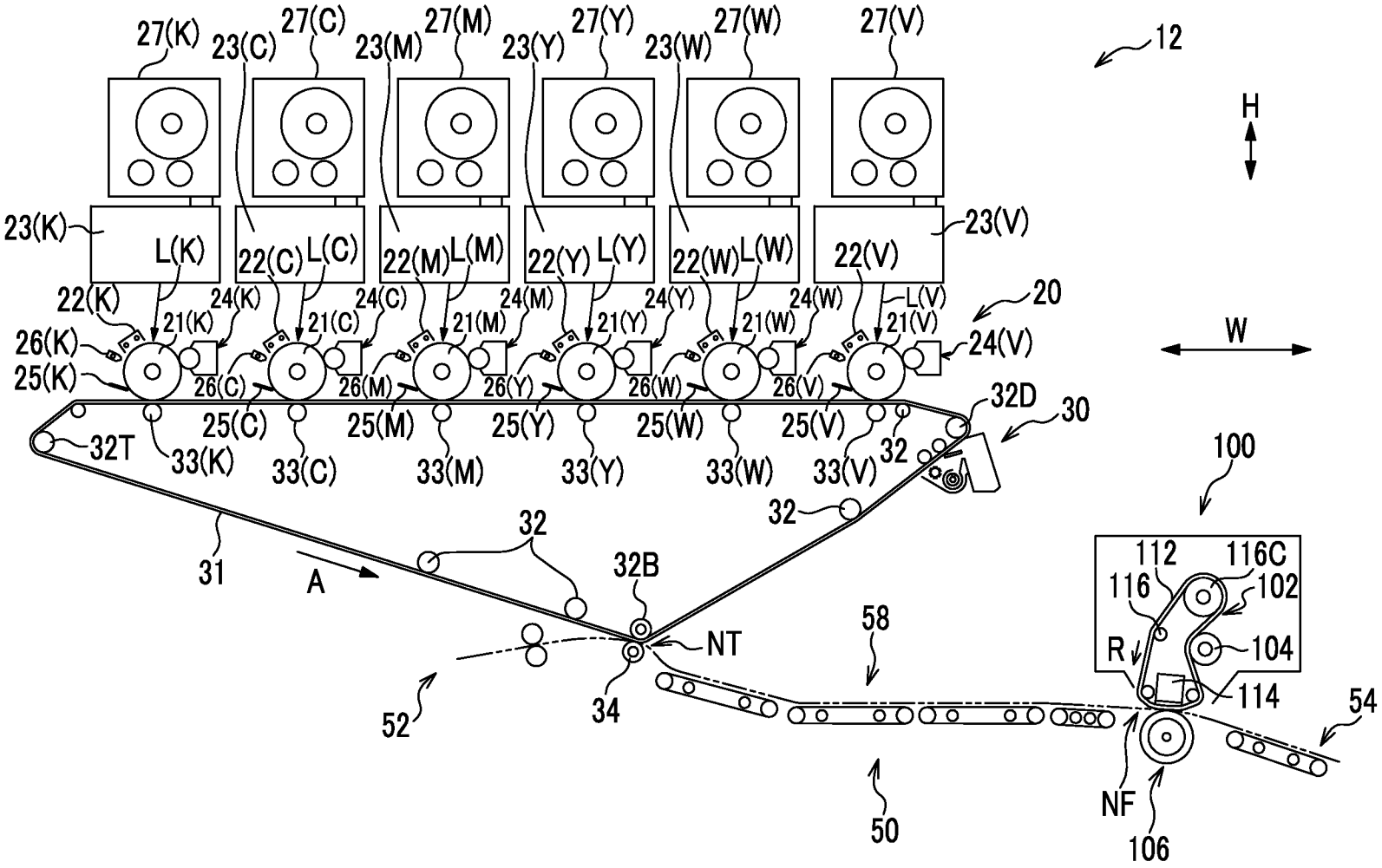
FIG. 2 is a schematic view showing the configuration of an image forming section related to the first exemplary embodiment.

As shown in FIG. 2, the image forming section 12 is configured to include a toner image forming section 20 that forms a toner image, a transfer device 30 that transfers the image formed by the toner image forming section 20 to the recording paper P, and a fixing device 100 that fixes the toner image, which is transferred to the recording paper P, on the recording paper P. The toner image forming section 20 is configured to include a photoconductor 21 as an example of an image holding member holding a latent image (electrostatic latent image), a charger 22, an exposure device 23, a developing device 24, and a cleaning device 25. Thereby, the image forming section 12 develops the latent image on the photoconductor 21 with toner to form a toner image, and transfers the toner image to the recording paper P to form an image.

Additionally, plural toner image forming sections 20 are provided so that a toner image is formed for every color. In the present exemplary embodiment, toner image forming sections 20 for a total of six colors of a first special color (V), a second special color (W), yellow (Y), magenta (M), cyan (C), and black (K) are provided. (V), (W), (Y), (M), (C), and (K) shown in FIG. 1 represent the above respective colors. The transfer device 30 transfers toner images equivalent to six colors from a transfer belt 31, to which the toner images equivalent to six colors are superimposed on each other and are primarily transferred, to the recording paper P in a transfer nip NT.

Photoconductor

A photoconductor 21 is formed in a cylindrical shape and rotationally driven around its own axis by a drive unit that is not shown. A photosensitive layer (not shown) having negative charging polarity as an example is formed on the outer peripheral surface of the photoconductor 21. In addition, a configuration in which an overcoat layer is formed on the outer peripheral surface of the photoconductor 21 may be adopted. The photoconductors 21 for respective colors are linearly arranged side by side along the apparatus width direction in plan view.

Charger

The charger 22 charges the outer peripheral surface (photosensitive layer) of the photoconductor 21 with negative polarity. In the present exemplary embodiment, a corona discharge type (non-contact charging type) scorotron charger is used as the charger 22.

Exposure Device

The exposure device 23 forms an electrostatic latent image on the outer peripheral surface of the photoconductor 21. Specifically, modulated exposure light L (refer to FIG. 3) is irradiated to the outer peripheral surface of the photoconductor 21 charged by the charger 22 according to image data received from an image signal processing section (not shown) that constitutes the controller 70. An electrostatic latent image is formed on the outer peripheral surface of the photoconductor 21 by the irradiation of the exposure light L by the exposure device 23. In the present exemplary embodiment, the exposure device 23 is configured to expose the surface of the photoconductor 21 while performing scanning with a light beam irradiated from a light source by a light scanning unit (optical system) including a polygon mirror and Fθ lens. Additionally, in the present exemplary embodiment, the exposure device 23 is provided for every color.

Developing Device

The developing device 24 develops the electrostatic latent image formed on the outer peripheral surface of the photoconductor 21 with the developer G containing toner T, to thereby form a toner image (toner image) on the outer peripheral surface of the photoconductor 21. Although details are omitted, the developing device 24 is configured to include at least a container 24A (refer to FIG. 3) that contains the developer G, and a developing roll 24B (refer to FIG. 3) that supplies the developer G contained in the container 24A to the photoconductor 21 while rotating the developer G. A toner cartridge 27 for replenishing the developer G is connected to the container 24A via a replenishing passage that is not shown. The toner cartridges 27 for respective colors are arranged side by side in the apparatus width direction in plan view above the photoconductors 21 and the exposure devices 23, and are individually made replaceable.

Toner

The particle diameter of the toner T is made equal to or less than 4.5 [μm]. In addition, the particle diameter of the toner T in the present exemplary embodiment is volume mean particle diameter D50v to be described below. In the present exemplary embodiment, as an example, the particle diameter of the toner T is 3.8 [μm], and the softening point thereof is 109 [° C.]. In addition, the softening point of the toner T is preferably 100 [° C.] or higher and 125 [° C.] or lower. Here, a flow tester: CFT500 (made by Shimadzu Corp.) is used, and ½ descending temperature (a temperature equivalent to ½ of the height from an outflow starting point to an ending point when a toner sample is made to melt and flow out) measured on the conditions that the diameter of dice pores is 0.5 [mm], pressurization load is 0.98 [MPa], and heating rate is 1 [° C./min] is used as the softening point of the toner T.

In detail, the toner T is configured to include, for example, toner particles containing a binder resin, a coloring agent, and if needed, other additives such as a release agent, and if needed, an external additive. In addition, in the present exemplary embodiment, a two-component developer in which the developer G contains the toner T and a carrier (not shown) is used as an example. However, since the carrier is recovered in a development step and is not used in a fixing step, description of the carrier is omitted.

Examples of the binder resin are not particularly limited, but include homopolymers and copolymers, such as styrenes (for example, styrene, chlorostyrene, and the like), monoolefins (for example, ethylene, propylene, butylene, isoprene, and the like), vinyl esters (for example, vinyl acetate, vinyl propionate, vinyl benzoate, vinyl butyrate, and the like), α-methylene aliphatic monocarboxylic acid esters (for example, methyl acrylate, ethyl acrylate, butyl acrylate, dodecyl acrylate, octyl acrylate, phenyl acrylate, methyl methacrylate, ethyl methacrylate, butyl methacrylate, dodecyl methacrylate, and the like), vinyl ethers (for example, vinyl methyl ether, vinyl ethyl ether, vinyl butyl ether, and the like), vinyl ketones (for example, vinyl methyl ketone, vinyl hexyl ketone, vinyl isopropenyl ketone, and the like); and polyester resins obtained by copolymerizing dicarboxylic acids and diols.

Particularly, representative examples of the binder resin include polystyrene, styrene-alkyl acrylate copolymer, styrene-alkyl methacrylate copolymer, styrene-acrylonitrile copolymer, styrene-butadiene copolymer, styrene-maleic anhydride copolymer, polyethylene resin, polypropylene resin, polyester resin, and the like. Additionally, representative examples of the binder resin also include polyurethane, epoxy resin, silicone resin, polyamide, modified rosin, paraffin wax, and the like.

Representative examples of the coloring agent include magnetic powder (for example, magnetite and ferrite, and the like), carbon black, aniline blue, Calco Oil Blue, chrome yellow, ultramarine blue, Du Pont oil red, quinoline yellow, methylene blue chloride, phthalocyanine blue, malachite green oxalate, lamp black, rose bengal, C. I. Pigment Red 48:1, C. I. Pigment Red 122, C. I. Pigment Red 57:1, C. I. Pigment Yellow 97, C. I. Pigment Yellow 17, C. I. Pigment Blue 15:1, C. I. Pigment Blue 15:3, and the like.

Examples of the other additives include a release agent, magnetic substance, a charging control agent, inorganic powder, and the like. Examples of the release agent include hydrocarbon-based wax; natural waxes such as carnauba wax, rice wax, and candy lilac wax; synthetic or mineral/petroleum-based waxes such as montan wax; and ester-based waxes such as fatty acid ester and montanoic acid ester, but are not limited to these.

Next, the characteristics of the toner T (toner particles) will be described. The toner T has an average shape factor (the number average of a shape factor represented by Shape factor=$(ML^2/A)\times(\pi/4)\times100$, where ML represents the maximum length of a particle and A represents the projected area of the particle) of preferably 100 or more and 150 or less, more preferably 105 or more and 145 or less, and most preferably 110 or more and 140 or less. Additionally, the particle diameter (volume mean particle diameter D50v) of the toner T is preferably equal to or less than 4.0 [μm] as already described.

As a method for measuring the volume average particle diameter D50v of the toner T, first, 0.5 [mg] or more and 50 [mg] or less of a measurement sample is added into 2 [ml] of a water solution with 5 weight [%] of a surfactant (preferably, alkyl benzenesulfonic acid sodium) as a dispersant, and this is added into 100 [ml] or more and 150 [ml] or less of an electrolyte. Dispersion treatment is performed to the electrolyte, having this measurement sample suspended therein, for about 1 minute by an ultrasonic dispersing unit, and the particle size distribution of particles whose particle diameter is within a range of 2.0 [μm] or more and 60 [μm] or less is measured using an aperture whose aperture diameter is 100 [μm], by a Coulter Multisizer II model (made by the Beckman Coulter, Inc.). The number of particles to be measured is set to 50,000. A cumulative distribution of the volume is subtracted from the small particle diameter side with respect to the particle size range (channel) divided on the basis of obtained particle size distribution, and the particle diameter at 50% accumulation is defined as a volume average particle diameter D50v.

Examples of the external additive include inorganic particles, and examples of the inorganic particles include $SiO_2$, $TiO_2$, $Al_2O_3$, CuO, ZnO, $SnO_2$, $CeO_2$, $Fe_2O_3$, MgO, BaO, CaO, $K_2O$, $Na_2O$, $ZrO_2$, $CaO.SiO_2$, $K_2O.(TiO_2)_n$, $Al_2O_3.2SiO_2$, $CaCO_3$, $MgCO_3$, $BaSO_4$, $MgSO_4$ and the like.

In addition, in the present exemplary embodiment, as an example, in the toner T, weight average molecular weight becomes 11000, number average molecular weight becomes 3500, and the amount of aluminum cross-linking (the amount of aluminum ions in the toner T) becomes 0.03 [kcps] (kilo counts/second). The number average molecular weight is preferably within a range of $1.0\times10^3$ or more and $5.0\times10^4$ or less, and the weight average molecular weight is preferably within a range of $7.0\times10^3$ or more and $5.0\times10^5$ or less. The toner T whose softening point is around 109 [° C.] is a low viscoelastic toner in which the amount of aluminum cross-linking is 0.03 [kcps], the toner T whose softening point is around 115 [° C.] is a middle viscoelastic toner in which the amount of aluminum cross-linking is 0.1 [kcps], and the toner T whose softening point is around 125 [° C.] is a high viscoelastic toner in which the amount of aluminum cross-linking is 0.14 [kcps].

Measurement of the amount of aluminum cross-linking is performed using an X-ray fluorescence spectrometer made by Rigaku Corp. (ZSX primusII). Respective samples used for measurement are obtained by pressurizing and molding samples of 0.13 [g]. In addition, measurement conditions are as follows.

Tube voltage: 60 [kV]

Tube current: 150 [mA]

Measuring time: 40 [sec]

Here, although the viscoelastic characteristics of the toner T are described as an example in the present exemplary embodiment after being substituted with the softening points as already described, dynamic viscoelastic temperature dependency measurement may be performed and management may be made at a maximum of tan δ. tan δ (tan Delta: dynamics loss tangent of dynamic viscoelasticity) is defined by G"/G' where storage elastic modulus G' and loss elastic modulus G" are obtained by the dynamic viscoelastic temperature dependency measurement. Here, G' is an elastic response component of the elastic modulus in the relationship of stress generated with respect to distortion during deformation, and energy with respect to deformation work is stored. A viscoelastic component of the elastic modulus is G". Additionally, tan δ defined by G"/G' is a barometer of the degree of loss or storage of the energy with respect to deformation work.

The storage elastic modulus G' and the loss elastic modulus G' may be measured using, for example, a rotating plate type rheometer (ARES made by TA Instruments). As an example of the measurement, a rheometer (ARES rheometer made by Rheometric Scientific, Inc) is used, and temperature rise measurement is performed on the condition of a frequency of 1 [Hz] using a parallel plate. Sample setting is performed at a temperature from about 120 [° C.] to 140 [° C.], and cooling to room temperature is made. Then, heating is made at a heating rate of 1 [° C./min], and the storage elastic modulus G', the loss elastic modulus G", and tan δ during a temperature rise are measured for every 1 [° C.].

Recording Paper

As the recording paper P, recording paper in which the smoothness [sec] measured by Paper Pulp Test Method No. 5-2:2000 (paper and paperboard: smoothness and air permeability test method) of Japan Technical Association of the Pulp and Paper Industry is equal to or less than 2000 [sec] is used as an example.

Gloss

The gloss in the present exemplary embodiment means glossiness that is obtained by fixing a toner image (toner T) on the recording paper P and performing measurement to this toner image at 60 [°] of JISK 5600-4-7 (JIS Z 8741). As an example, Model 4430 micro-TRI-gloss made by BYK-Gardner is used as a measuring instrument.

Relationship Between Toner and Gloss

Figure 6B:
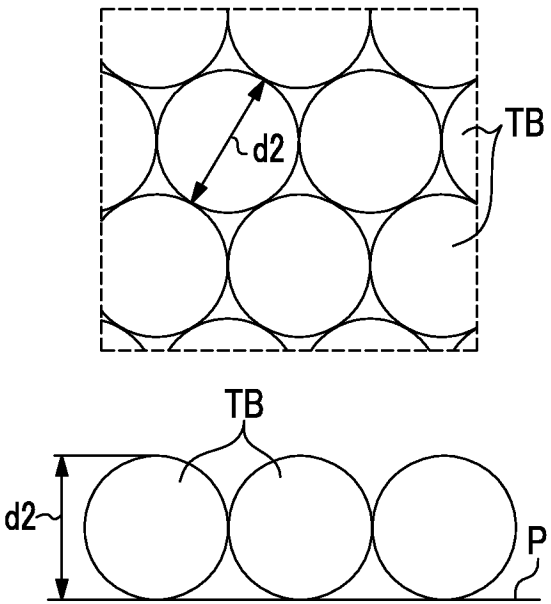
FIG. 6B is a schematic view showing a filled state of toner and toner height on a recording paper related to a comparative example.
Figure 6A:
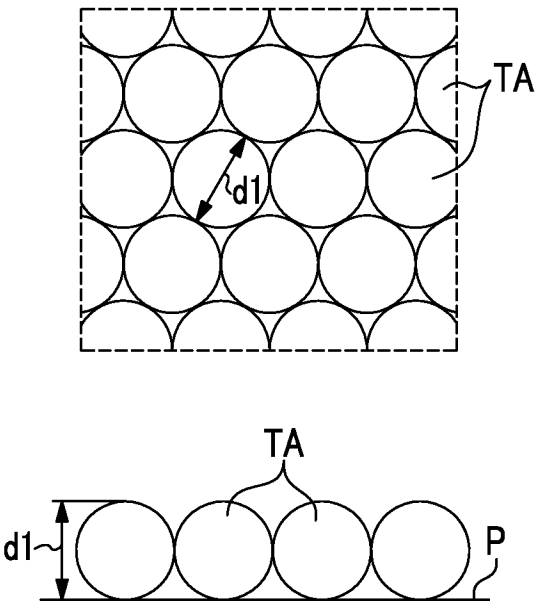
FIG. 6A is a schematic view showing a filled state of toner and toner height on a recording paper related to the first exemplary embodiment.

As shown in FIGS. 6A and 6B, the particle diameter of toner particles TA of the present exemplary embodiment is set to d1 (=3.8 [μm]), and as a comparative example, the particle diameter of toner particles TB of the related art with a larger particle diameter than the toner particles TA of the present exemplary embodiment is set to d2 (as an example, 5.8 [μm]). In a case where the toner particles TB of the comparative example are made small and made into the toner particles TA of the present exemplary embodiment, the total amount of a pigment decreases and color gamut (color reproduction zone) becomes narrow. Thus, it is necessary to increases the pigment by 5.8/3.8 times.

However, if the percentage of the pigment in the toner T is raised, the viscoelasticity of the toner increases (becomes hard), and the toner become difficult to melt at a fixing temperature of the related art. For this reason, if fixing is performed on the fixing conditions (including temperature, pressure, and heating time) of the related art, gloss will be lowered. Here, although changing the molecular weight and amount of aluminum cross-linking of the toner T is mentioned as one of means that increase the lowered gloss, the change of molecular weight and the amount of aluminum cross-linking needs to modify various fixing conditions, and is not simple.

Additionally, if the particle diameter of the toner T becomes small, pile height (layer thickness) decreases. However, if pressure is made to act to the toner T in this state, the toner is easily influenced by the base of the recording paper P, and the sensitivity of gloss will rise. For these reasons, in the present exemplary embodiment, the adjustable range of the gloss (glossiness) of the toner T after fixing (toner image) is kept from becoming narrow by specifying the configuration of the fixing device 100 (refer to FIG. 1) to be described below.

Cleaning Device

Figure 3:
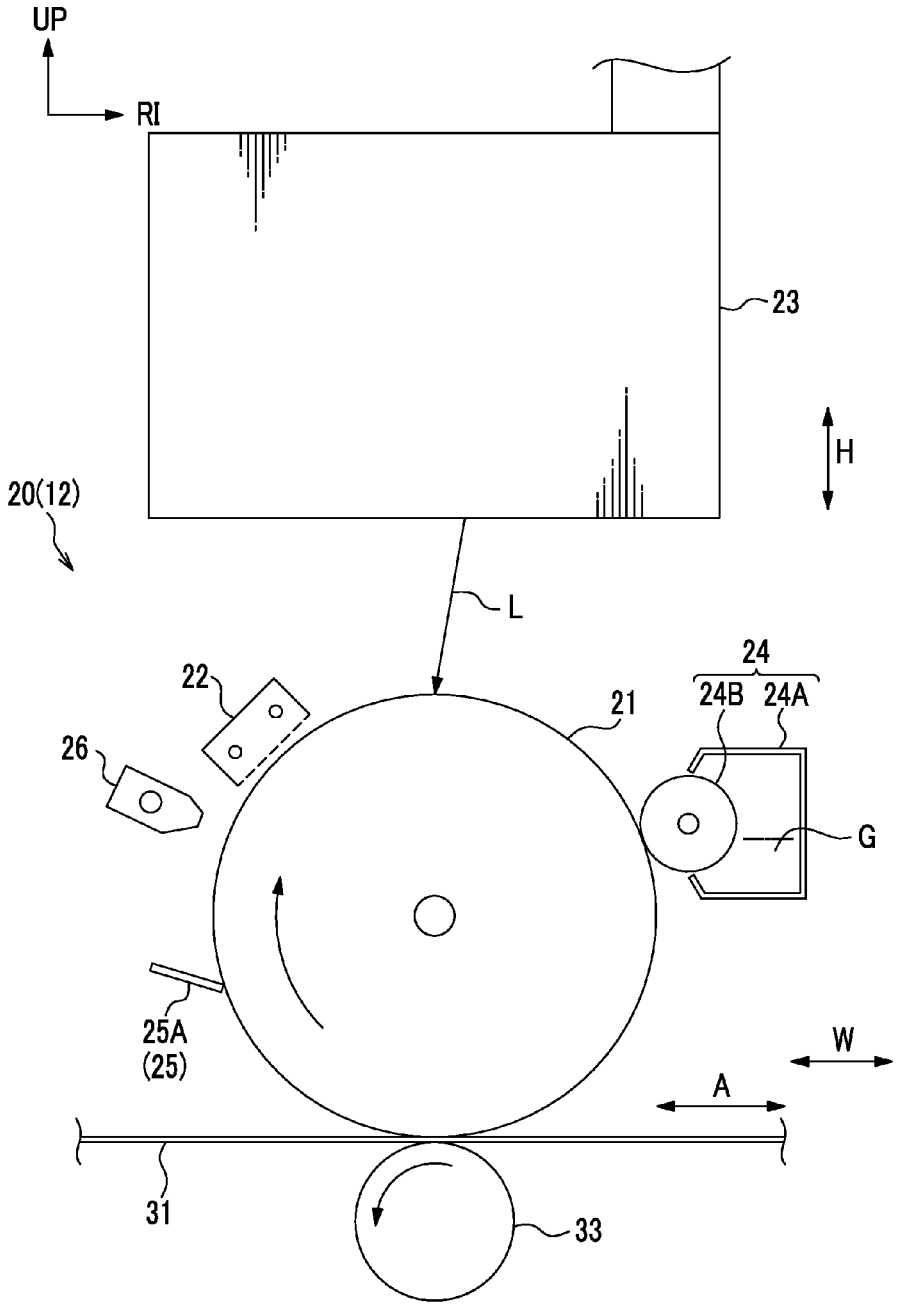
FIG. 3 is a schematic view showing the configuration of a toner image forming section related to the first exemplary embodiment.

As shown in FIG. 3, the cleaning device 25 includes a blade 25A that scrapes off the toner T, which remains on the surface of the photoconductor 21 after the transfer of the toner image to the transfer device 30, from the surface of the photoconductor 21 (refer to FIG. 2). Although illustration is omitted, the cleaning device 25 is configured to further include a housing that recovers the toner T scraped off by the blade 25A, and a transporting device that transports the toner T within the housing to a waste toner box.

Transfer Device

As shown in FIG. 2, the transfer device 30 superimposes toner images of the photoconductors 21 for respective colors on the transfer belt 31, primarily transfers the superimposed toner images, and secondarily transfers the superimposed toner images to the recording paper P.

Specifically, the transfer belt 31 forms an endless shape, and is wound around plural rolls 32, whereby the posture thereof is determined. In the present exemplary embodiment, the transfer belt 31 is adapted to take a reverse obtuse triangular posture that is elongate in the apparatus width direction in plan view. A roll 32D among the plural rolls 32 functions as a driving roll that circulates the transfer belt 31 in the direction of arrow A by the power of a motor that is not shown. Additionally, a roll 32T functions as a tension imparting roll that imparts tension to the transfer belt 31. A roll 32B functions as a facing roll of a secondary transfer roll 34.

Moreover, the transfer belt 31 comes into contact with the photoconductors 21 for respective colors from below at an upper side portion that extends in the apparatus width direction in the above-described posture, and the images of the respective photoconductor 21 are transferred under the application of a transfer bias voltage from a primary transfer roll 33. Additionally, the transfer belt 31 has the secondary transfer roll 34 brought into contact therewith at a top portion on the side of a lower end that forms an obtuse angle, to form a transfer nip NT, and receives the application of the transfer bias voltage from the secondary transfer roll 34 to transfer the toner images to the recording paper P that passes through the transfer nip NT.

Fixing Device

The fixing device 100 fixes the toner images on the recording paper P to which the toner images are transferred in the transfer device 30. In the present exemplary embodiment, the fixing device 100 is configured to pressurize and heat the toner images in a fixing nip part NF to be described below and thereby fix the toner images on the recording paper P. In addition, the details of the fixing device 100 will be described below.

Medium Transporting Section

As shown in view 1, the medium transporting section 50 is configured to include a medium supply part 52 that supplies the recording paper P to the image forming section 12, and a medium discharge part 54 that discharges the recording paper P on which an image is formed. Additionally, the medium transporting section 50 is configured to include a medium return part 56 that is used when images are formed on both surfaces of the recording paper P, and an intermediate transporting part 58 that transports the recording paper P from the transfer device 30 to the fixing device 100.

The medium supply part 52 is adapted to supply the recording paper P sheet by sheet to the transfer nip NT of the image forming section 12 in tune with transfer timing. The medium discharge part 54 is adapted to discharge the recording paper P (on which an image is formed), on which toner images are fixed in the fixing device 100, to the outside of the apparatus. The medium return part 56 reverses the front and back of the recording paper P, and returns the recording paper P to the image forming section 12 (medium supply part 52) when an image is formed on the other surface of the recording paper P that has the toner images fixed on one surface.

Post-Processing Section

The post-processing section 60 is configured to include a medium cooling part 62 that cools the recording paper P on which an image is formed in the image forming sections 12, a correcting device 64 that corrects the bending of the recording paper P, and an image inspection part 66 that inspects the image formed on the recording paper P. The medium cooling part 62, the correcting device 64, and the image inspection part 66 are arranged in this order from the upstream side in the discharge direction of the recording paper P in the medium discharge part 54, and perform the above post-processing to the recording paper P in a discharge step by the medium discharge part 54.

Image Forming Operation

Next, the outline of an image forming step to the recording paper P by the image forming apparatus 10 and its post-processing step will be described.

As shown in FIG. 1, the controller 70 that has received an image forming command operates the toner image forming section 20, the transfer device 30, and the fixing device 100. Thereby, the photoconductor 21 and the developing roll 24B (refer to FIG. 3) are rotated, and the transfer belt 31 is circulated. Additionally, a pressurizing roll 106 to be described below is rotated, and the fixing belt 112 is circulated. Moreover, the controller 70 operates the medium transporting section 50 or the like in synchronization with this operation.

Thereby, the photoconductors 21 for respective colors are charged by the chargers 22 while being rotated. Additionally, the controller 70 sends image data, which has been subjected to image processing in the image signal processing section, to the respective exposure devices 23. The respective exposure devices 23 emit exposure light L according to image data, and exposes the respective charged photoconductors 21 to the exposure light. Then, electrostatic latent images are formed on the outer peripheral surfaces of the respective photoconductors 21. The electrostatic latent images formed on the respective photoconductors 21 are developed with developer (toner) supplied from the developing devices 24. Thereby, toner images of corresponding colors among the first special color (V), the second special color (W), yellow (Y), magenta (M), cyan (C), and black (K) are formed on the photoconductors 21 for respective colors.

The toner images of the respective colors formed on the photoconductors 21 for respective colors are sequentially transferred to the circulating transfer belt 31 by the application of transfer bias voltages through the primary transfer rolls 33 for respective colors. Thereby, superimposed toner images in which the toner images equivalent to six colors are superimposed are formed on the transfer belt 31. The superimposed toner images are transported to the transfer nip NT by the circulation of the transfer belt 31. The recording paper P is supplied to the transfer nip NT by the medium supply part 52 in tune with the transport of the superimposed toner images. Then, the superimposed toner images are transferred to the recording paper P from the transfer belt 31 as a transfer bias voltage is applied to the transfer nip NT.

The recording paper P to which the toner images are transferred is transported toward the fixing nip part NF of the fixing device 100 from the transfer nip NT of the transfer device 30 by the intermediate transporting part 58 while being suctioned with negative pressure. The fixing device 100 imparts heat and a pressurizing force (fixing energy) to the recording paper P that passes through the fixing nip part NF. Thereby, the toner images transferred to the recording paper P are fixed on the recording paper P.

The recording paper P discharged from the fixing device 100 is subjected to processing by the post-processing section 60 while being transported toward a discharge medium receiving part outside the apparatus by the medium discharge part 54. In detail, the recording paper P heated by the fixing step is first cooled in the medium cooling part 62. Next, the bending of the recording paper P is corrected by the correcting device 64. Moreover, as for the toner images fixed on the recording paper P, the presence/absence or degree of a toner concentration defect, an image defect, an image position defect, and the like are detected by the image inspection part 66. Then, the recording paper P is transported to the medium discharge part 54.

On the other hand, in a case where an image is formed on a non-image surface of the recording paper P on which an image is not formed (in the case of double-sided printing), the controller 70 switches the transporting path of the recording paper P after the passage of the image inspection part 66 from the medium discharge part 54 to the medium return part 56. Thereby, the recording paper P has the front and back reversed, and is fed to the medium supply part 52. An image is formed (fixed) on the rear surface of the recording paper P in the same step as the image forming step to the above surface. This recording paper P undergoes the same process as the post-processing step after the formation of an image to the above surface, and is discharged to the outside of the apparatus by the medium discharge part 54.

Configuration of Main Parts

Figure 4:
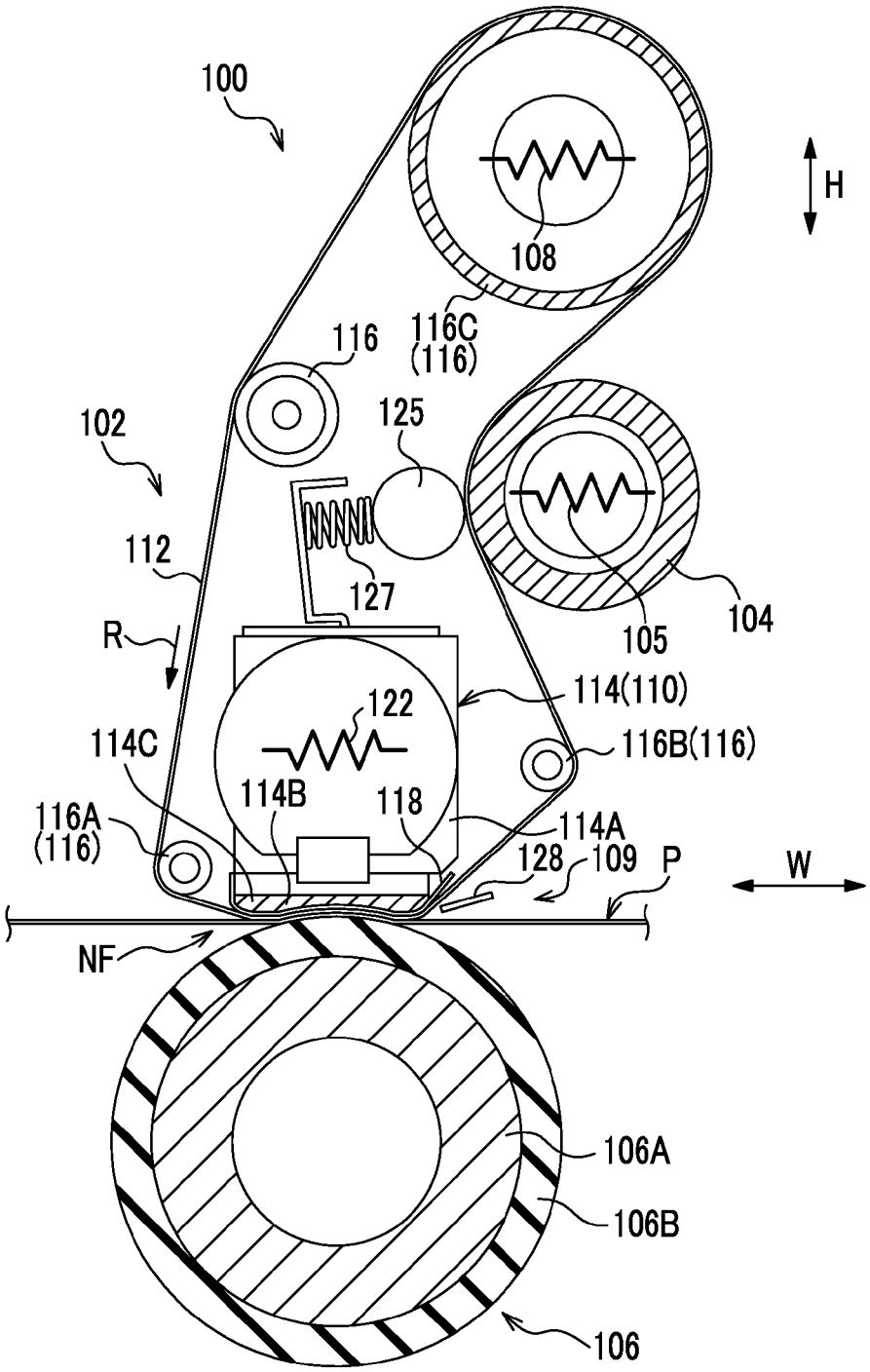
FIG. 4 is a schematic view showing the configuration of a fixing device related to the first exemplary embodiment.

As shown in FIG. 4, the fixing device 100 is configured to include a fixing belt module 102 having a fixing belt 112 as an example of a fixing rotary body that heats the toner T together with the recording paper P while pressurizing the toner, and fixes the toner on the recording paper P, halogen lamps 105, 108, and 122 as examples of heating units that heat the fixing belt 112, and the pressurizing roll 106 as an example of a pressurizing unit that sandwiches and pressurizes the toner T and the recording paper P by the fixing belt 112. An external roll 104 is provided outside the fixing belt 112.

Additionally, in the fixing device 100, the fixing belt 112 and the pressurizing roll 106 come into contact with each other, and form the fixing nip part NF as an example of a contact part. The width from an inlet to an outlet in the fixing nip part NF is W1 (refer to FIG. 5). In addition, the width W1 of the fixing nip part NF in the present exemplary embodiment means the distance from a position on an inlet side where the pressurizing force is 0 [Pa] to a position on an outlet side where the pressurizing force becomes 0 [Pa] again through a position where the pressurizing force becomes a maximum pressure.

Moreover, the fixing device 100 is elongated in the apparatus depth direction, is provided at a position corresponding to the fixing nip part NF inside the fixing belt 112, and is configured to include a pad member 114 as an example of a supporting member that receives the pressurizing force of the pressurizing roll 106 and supports the fixing belt 112, a peeling pad mechanism 109 for peeling the tip of the recording paper P, which has passed through the fixing nip part NF, from the fixing belt 112, and a switching mechanism 140 (refer to FIG. 5) that applies pressure to the pad member 114. The fixing belt module 102 includes the fixing belt 112, the pad member 114, and plural rolls 116 that have the direction of rotation axes in the apparatus depth direction, respectively.

The fixing belt 112 forms an endless (annular) shape that opens to both sides in the apparatus depth direction orthogonal to the transporting direction of the recording paper P. Additionally, although the illustration of the fixing belt 112 is omitted, as an example, the fixing belt is configured so that an elastic layer (intermediate layer) of a thickness of 450 [μm] made of silicone rubber is formed on a base material of a thickness of 80 [μm] made of polyimide, and a fluororesin-based release layer of a thickness of 30 [μm] is formed on the elastic layer. Since the elastic layer (intermediate layer) is preferably 190 [μm] or more and 600 [μm] or less, the total thickness of the fixing belt 112 becomes 300 [μm] or more and 710 [μm]. The fixing belt 112 takes a posture that is wound and determined around the pad member 114, the plural rolls 116, and the external roll 104, and circulates in the direction of arrow R shown by FIG. 4 (on a circulating track along the posture) while the posture is maintained.

The pad member 114 is arranged inside the fixing belt 112, and is configured to include a main body 114A, and a pad 114B that is fixed to the undersurface of the main body 114A and comes into contact with the fixing belt 112. The pad member 114 receives the pressing (nip) load from the pressurizing roll 106 in a nip forming surface 114C that constitutes a surface of the pad 114B on the fixing belt 112 side, and thereby forms the fixing nip part NF as already described between the fixing belt 112 and the pressurizing roll 106. In addition, the pad member 114 is fixed to an apparatus frame 130 (refer to FIG. 5), and does not follow the circulation of the fixing belt 112.

The nip forming surface 114C of the pad member 114 is formed as a curved surface that is concaved in a circular-arc shape on the pressurizing roll 106 side as viewed from the apparatus depth direction. By virtue of this shape, the pad member 114 forms the fixing nip part NF that is elongated in the transporting direction of the recording paper P as compared to a configuration in which a roll that supports a nip load is provided between the fixing belt 112 and the pressurizing roll 106 instead of the pad member 114.

Although the pad 114B of the pad member 114 may be made of either metal or resin, the pad 114B is made of metal as an example in the present exemplary embodiment. In addition, a high-hardness synthetic resin like a liquid crystal polymer may be used as an example of this resin.

A sliding sheet 118 is interposed between the fixing belt 112 and the nip forming surface 114C of the pad member 114. The surface of the sliding sheet 118 that comes into contact with at least the fixing belt 112 is made of, for example, low-friction materials, such as fluororesin. This provides a configuration in which frictional resistance around the fixing belt 112 is reduced.

Figure 7:
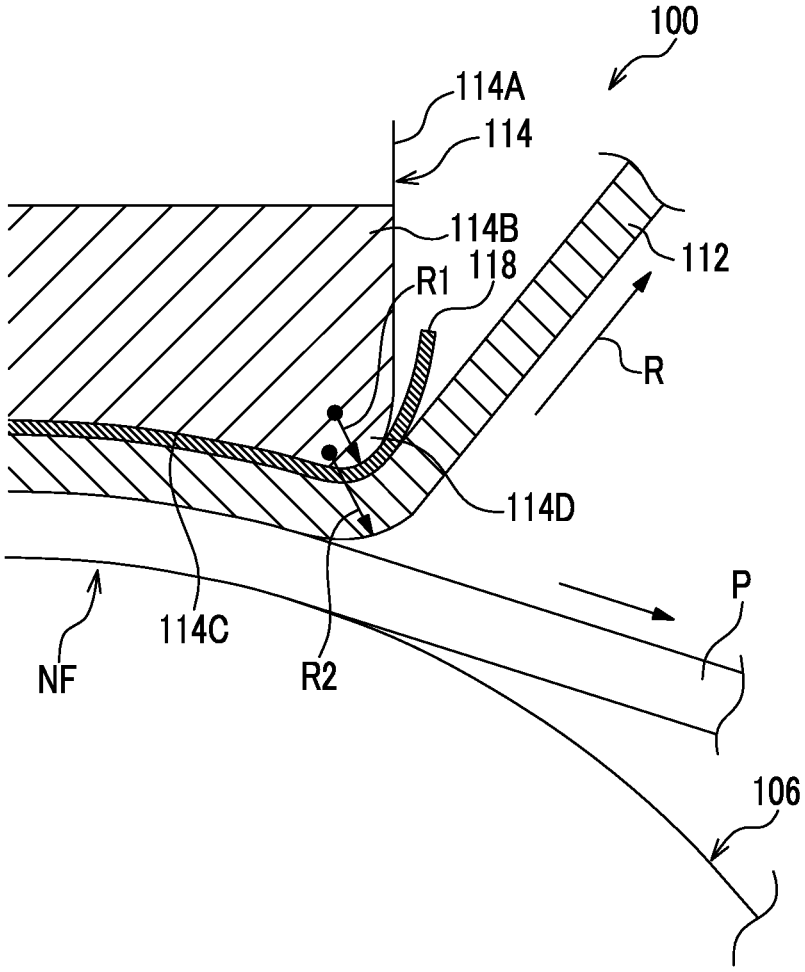
FIG. 7 is a schematic view showing the curvature radius of a pad member and the fixing belt on a fixing nip part outlet side related to the first exemplary embodiment.

As shown in FIG. 7, as for the pad member 114, the curvature radius R1 of a part (a part that comes into contact with the fixing belt 112) around which the fixing belt 112 is wound on the downstream side in the transporting direction of the recording paper P is set to 6 [mm] or less, and becomes 6 [mm] as an example. The dimensional tolerance of the curvature radius R1 is set to ±500 [μm]. The curvature radius R2 of the fixing belt 112 at a downstream end portion of the fixing nip part NF becomes equal to or less than 7 [mm] as an example. The dimensional tolerance of the curvature radius R2 is set to ±500 [μm]. In addition, the thickness of the sliding sheet 118 becomes 100 [μm] or more and 300 [μm] or less, and the thickness of the fixing belt 112 becomes 400 [μm] or more and 450 [μm] or less.

As shown in FIG. 4, the halogen lamp 122 is provided within the main body 114A of the pad member 114. The pad member 114 functions also as a heat transfer member that transfers heat, which has been radiated from the halogen lamp 122, to the fixing belt 112 via the nip forming surface 114C.

Rolls 116A and 116B that are located on both upstream and downstream sides in the circulating direction of the fixing belt 112 with respect to the pad member 114 among the plural rolls 116 function as posture correcting rolls. Specifically, the respective rolls 116A and 116B are adapted to suppress changes in the circulating direction of the fixing belt 112 before and after the fixing nip part NF (makes the bending angle of the fixing belt 112 at both ends of the fixing nip part NF obtuse).

A roll 116C that is located farthest from the pad member 114 along the plural rolls 116 has the halogen lamp 108 provided therein, and functions as an internal heating roll that heats the fixing belt 112 from the inner peripheral side. In the present exemplary embodiment, the roll 116C functions also as a steering roll that may tilt its axis in the apparatus depth direction to thereby adjust the position of the fixing belt 112 in the width direction (apparatus depth direction).

The pressurizing roll 106 is configured, as an example, so that an elastic body layer 106B made of silicone rubber is coated on the outer periphery of a columnar roll body 106A made of aluminum. In addition, although illustration is omitted, a release layer whose outer peripheral surface is made of fluororesin or the like of a film thickness of 100 [μm] is formed on the outer periphery of the elastic body layer 106B. The pressurizing roll 106 is rotated by a driving source that is not shown, to thereby apply a driving force for circulating to the fixing belt 112.

The external roll 104 is arranged between the roll 116B and the roll 116C on the downstream side of the pad member 114, in the circulating direction of the fixing belt 112. The external roll 104 functions as an external heating roll that heats the fixing belt 112 from the outer peripheral side. Specifically, the external roll 104 transmits heat, which has been radiated from the halogen lamp 105 provided in the external roll, to the fixing belt 112. Additionally, the external roll 104 is rotated by a driving source that is not shown, to thereby apply a driving force for circulation to the fixing belt 112. In the present exemplary embodiment, the pressurizing roll 106 is used as a main driving roll that mainly applies a driving force to the fixing belt 112, and the external roll 104 is regarded as an auxiliary driving roll.

Additionally, the fixing belt module 102 includes a pressing roll 125 that presses the fixing belt 112 against the external roll 104 from the inner peripheral side. The pressing roll 125 presses the fixing belt 112 against the external roll 104 with the load that is determined under the biasing of a spring 127. In addition, the fixing belt module 102 is integrally attachable and detachable to the apparatus frame 130 (refer to FIG. 5) as a module constituted by the fixing belt 112, the pad member 114, the respective rolls 116, and the like.

The peeling pad mechanism 109 has a peeling pad 128 that is arranged downstream of the fixing nip part NF in the transporting direction of the recording paper P, and causes the tip of the peeling pad 128 to approach the fixing nip part NF.

Position Switching Mechanism of Pressurizing Roll

Figure 5:
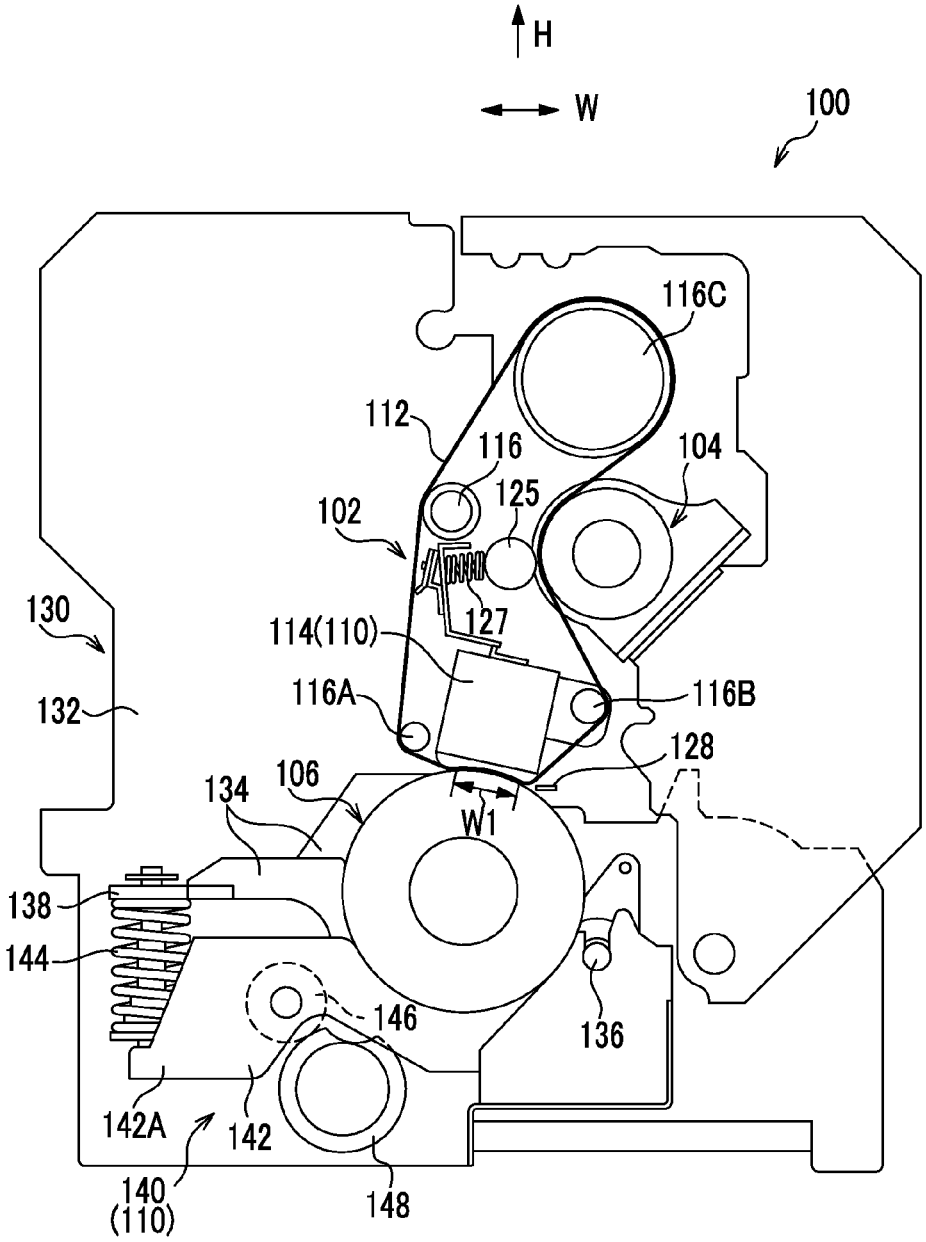
FIG. 5 is a schematic view showing a contact state of a pressurizing roll to a fixing belt by a position switching mechanism in the fixing device related to the first exemplary embodiment.

As shown in FIG. 5, the fixing device 100 is configured so that the pressurizing roll 106 is brought into contact with or separated from the fixing belt module 102 by the switching mechanism 140 to be described below. Specifically, the pressurizing roll 106 is configured so as to be switchable between a contact position where the pressurizing roll is brought into contact with the fixing belt 112 to form the fixing nip part NF, and a separation position where the pressurizing roll is separated from the fixing belt 112, though illustration is omitted.

The fixing device 100 includes the apparatus frame 130. The apparatus frame 130 is configured to include a stationary frame 132, and a movable frame 134 that is displaced relative to the stationary frame 132. In the present exemplary embodiment, the movable frame 134 is made rotatable relative to the stationary frame 132 around a pivot 136 having an axial direction in the apparatus depth direction.

The stationary frame 132 fixedly supports the pad member 114, and supports the respective rolls 116 so as to be rotatable around their respective axes. Thereby, the fixing belt module 102 is configured so as not to be displaced relative to the stationary frame 132 except for the operation around the fixing belt 112 and the rotational operation of the respective rolls 116.

On the other hand, the pressurizing roll 106 is rotatably supported by the movable frame 134. The pressurizing roll 106 is adapted so that the position thereof is switched to any of the contact position shown in FIG. 5 and the separation position (not shown) as the movable frame 134 rotates around the pivot 136 with respect to the stationary frame 132.

More specifically, the movable frame 134 has a load input part 138 that is arranged opposite to the pivot 136 across the pressurizing roll 106 in the apparatus longitudinal direction. The pressurizing roll 106 is adapted to be held in the contact position by adding an upward load to the load input part 138. This holding load is supported by the stationary frame 132 via the pad member 114. Additionally, if the upward load to the load input part 138 is removed, the pressurizing roll 106 is configured to rotate downward around the pivot 136 together with the movable frame 134 under its own weight and be moved to the separation position side. In addition, the pressurizing roll 106 may be configured to be moved to the separation position side by the restoring force of an elastic member that is not shown.

The switching mechanism 140 is configured to switch a state where an upward load is applied to the load input part 138 of the movable frame 134 and a state where this load is removed. Hereinafter, specific description will be made.

The switching mechanism 140 includes a push arm 142. The push arm 142 is rotatably supported around the pivot 136 with respect to the stationary frame 132 together with the movable frame 134. The other end portion 142A of the push arm 142 is arranged below the load input part 138 of the movable frame 134, and a compression coil spring 144 is interposed between the other end portion and the load input part 138.

Additionally, an inner ring of a bearing 146 that functions as a cam follower is fixed between the pivot 136 and the compression coil spring 144 in the push arm 142. The switching mechanism 140 includes a cam 148 that supports the push arm. 142 from below while coming into contact with an outer ring of the bearing 146. The cam 148 is rotatably supported by the stationary frame 132, and is rotated by a motor that is not shown.

Here, in a state where a major-axis portion of the cam 148 comes into contact with the outer ring of the bearing 146, as shown in FIG. 5, the push arm 142 is brought into a substantially horizontal posture, and the pressurizing roll 106 is located at the contact position. In this state, the upward load according to the amount of compression of the compression coil spring 144 is added to the load input part 138 of the movable frame 134. That is, the pressurizing roll 106 is adapted to come into contact with the fixing belt 112 with nip pressure within a predetermined range.

On the other hand, in a state where a minor-axis portion of the cam 148 comes into contact with the outer ring of a bearing 146, though illustration is omitted, the push arm 142 is brought into a posture that is tilted in a direction in which the other end portion 142A descends, and the extension of the compression coil spring 144 is limited by a stopper that is not shown. For this reason, the pressurizing roll 106 is separated from the fixing belt 112 under its own weight, and the upward load is removed from the load input part 138 of the movable frame 134. In this state, the pressurizing roll 106 and the movable frame 134 are adapted to be held at the separation position (lower movement limit) via the push arm 142 and the cam 148.

If the above is summarized, in the fixing device 100, the position of the pressurizing roll 106 with respect to the fixing belt 112 is selectively switched to any of the contact position and the separation position according to the rotational position of the cam 148 of the switching mechanism 140. Also, in the present exemplary embodiment, the pressurizing roll 106 is located at the separation position by the control of the controller 70 (refer to FIG. 1) at the stop of the image forming apparatus 10, at the warm-up of the fixing device 100, or the like. Additionally, in the fixing device 100, the pressurizing roll 106 comes into contact with the fixing belt 112 as the load input part 138 side of the movable frame 134 rotates upward around the pivot 136.

The roll 116A that is located on the upstream side in the circulating direction of the fixing belt 112 at the fixing nip part NF out of the two rolls 116A and 116B is arranged inside the fixing belt 112 so as to lie next to the pad member 114 on the upstream side in the transporting direction of the recording paper P to the fixing nip part NF. The fixing belt 112 wound around the roll 116A is used as a track where a circulating track to the fixing nip part NF runs along the transporting path of the recording paper P (brought close to parallelism). For this reason, the bending angle (track) of the fixing belt 112 before and after the fixing nip part NF is made obtuse.

Setting of Respective Parameters of Fixing Device

In the fixing device 100 shown in FIG. 4, the width W1 (=V·t) of the fixing nip part NF is set to 10 [mm] in consideration of the transporting speed V [mm/msec (milliseconds)] and heating time t [msec (milliseconds)] of the recording paper P. Then, fixing is performed while changing the heating time t (transporting speed V), and a minimum fixing temperature [° C.] in each condition is checked.

In addition, when a state where toner is not peeled, if a fixed toner image rubbed with a person's nail is regarded as a determination criterion for 'no poor fixing', the minimum fixing temperature is the value of a minimum temperature among the temperatures of the fixing belt 112 that become 'no poor fixing'. Additionally, the type of the recording paper P to be used is four paper types of A, B, C, and D. The basis weight (thickness of paper) is Paper Type A<Paper Type B<Paper Type C<Paper Type D, Paper Type A is the thinnest, and Paper Type D is the thickest.

Figure 8:
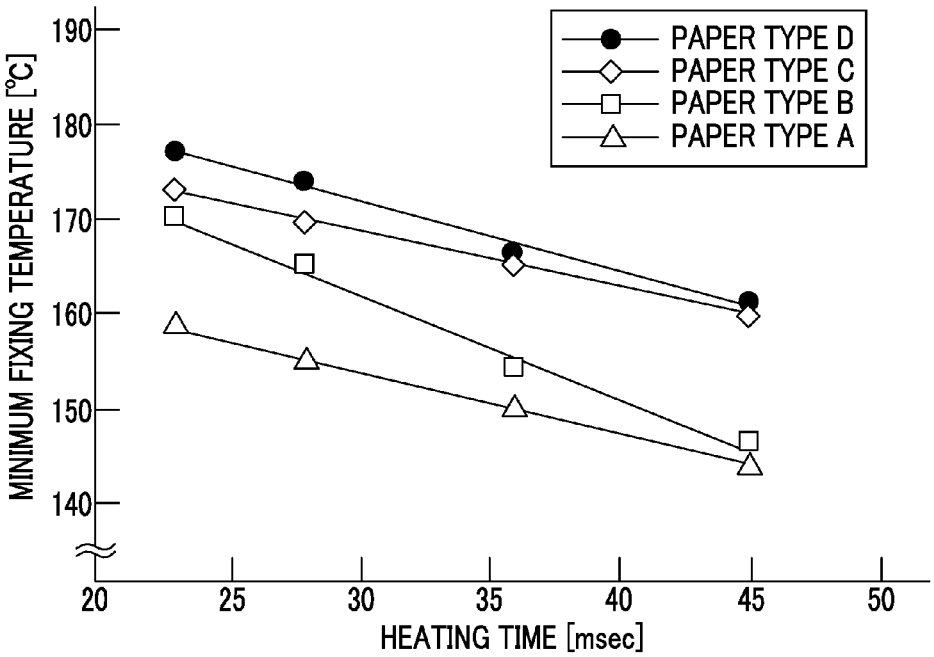
FIG. 8 is a graph showing changes in a minimum fixing temperature when heating time is changed, in the fixing device related to the first exemplary embodiment.

As shown in FIG. 8, as the heating time is shorter, the minimum fixing temperature rises. In the thinnest Paper Type A, the minimum fixing temperature is about 145 [° C.] in a heating time of 45 [msec], and the minimum fixing temperature rises to near 160 [° C.] in a heating time of 23 [msec]. Additionally, in the thickest Paper Type D, the minimum fixing temperature is about 163 [° C.] in a heating time of 45 [msec], and the minimum fixing temperature rises to near 180 [° C.] in a heating time of 23 [msec].

Figure 9:
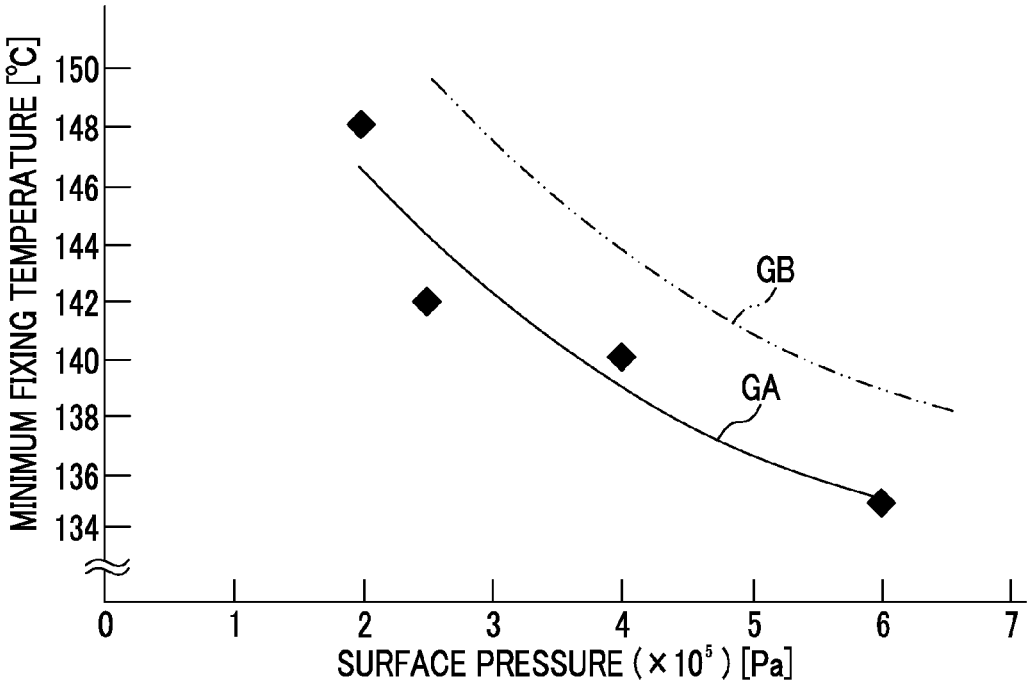
FIG. 9 is a graph showing changes in the minimum fixing temperature when the surface pressure of the fixing nip part is changed, in the fixing device related to the first exemplary embodiment.

Next, as shown in FIGS. 5 and 9, in the fixing device 100, changes in the minimum fixing temperature when the surface pressure within the fixing nip part NF (the maximum pressure) is changed are confirmed, with the width of the fixing nip part NF being set to W1=10 [mm] and the heating time being set to 20 [msec]. In addition, a graph GA (an approximated curve of a rhomboidal plot) shown by a solid line is a case where the recording paper P is Paper Type A, and a graph GB shown by a two-dot chain line is a case where the recording paper P is Paper Type D. Here, as shown on the graph GA, the minimum fixing temperature rises as the surface pressure becomes lower. The minimum fixing temperature is about 135 [° C.] at a surface pressure of $6\times10^5$ [Pa], and the minimum fixing temperature is about 142 [° C.] at a surface pressure of $3\times10^5$ [Pa].

Referring to the results shown in FIGS. 8 and 9, in the fixing device 100 (refer to FIG. 5), the maximum pressure in the fixing nip part NF is set to $2.9\times10^5$ [Pa] or more. In the present exemplary embodiment, as an example, the maximum pressure is set to $3.0\times10^5$ [Pa]. In addition, the maximum pressure is measured using a tactile sensor system made by Nitta, Inc.

Additionally, in the fixing device 100, the width W1 of the fixing nip part NF in a movement direction of the recording paper P is set to 10 [mm] or more. In the present exemplary embodiment, as an example, the width W1 is set to 10 [mm]. Moreover, in the fixing device 100, the heating time of the toner T in the fixing nip part NF is set to 20 [msec] or more.

In the present exemplary embodiment, as an example, the heating time is set to 20 [msec] as already described.

Operation

Next, the operation of the first exemplary embodiment will be described.

Basic Operation of Fixing Device

As shown in FIGS. 1 and 4, the fixing device 100 is prepared to operate by a command from the controller 70 prior to the operation of image formation (transfer) to the recording paper P in the image forming section 12. Specifically, the fixing belt 112 circulates along a predetermined track by the driving of the pressurizing roll 106 and the external roll 104. Additionally, the temperature of the fixing belt 112 rises to a predetermined temperature range by the heat generation of the halogen lamps 105, 108, and 122, and is maintained in the temperature range. The fixing belt 112 is heated while circulating, whereby the temperatures of respective parts thereof are brought into predetermined ranges.

Subsequently, if the recording paper P on which the toner images are transferred in the transfer device 30 is introduced into the fixing nip part NF by the intermediate transporting part 58, the fixing device 100 adds pressure and heat (fixing energy) to the recording paper P while transporting the recording paper P. Thereby, the toner images are fixed on the recording paper P.

Subsequently, the tip of the recording paper P that has passed through the fixing nip part NF enters between the peeling pad 128 of the peeling pad mechanism 109, and the pressurizing roll 106. Specifically, the fixing belt 112 circulates along an R shape (and a circulating track formed by the downstream roll 116B) formed at a downstream end portion in the transporting direction of the recording paper P in the nip forming surface 114C of the pad member 114, so as to separate from the transporting path of the recording paper P. For this reason, the tip of the recording paper P separates from the fixing belt 112 by its stiffness (restoration) (does not follow the track of the fixing belt 112), and enters between the peeling pad 128 of the peeling pad mechanism 109, and the pressurizing roll 106. Then, the recording paper P is peeled from the fixing belt 112 as being transported. The recording paper P is fed from the fixing device 100 in this way.

Adjustable Range of Gloss of Toner Image

Figure 10:
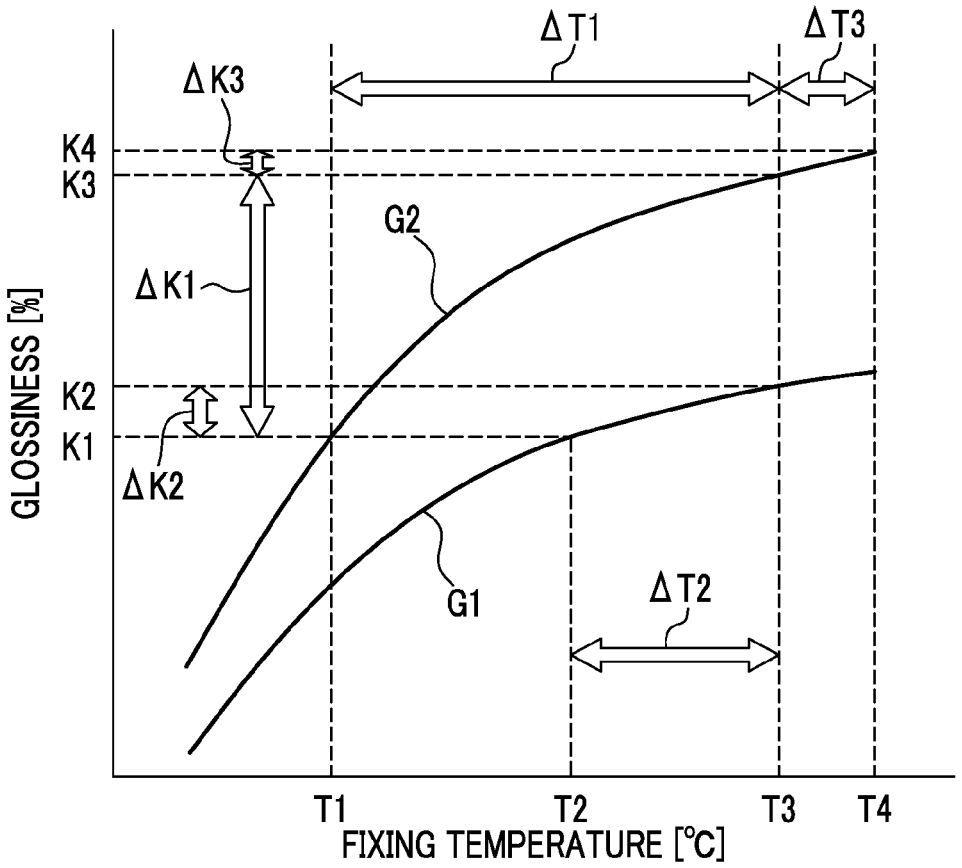
FIG. 10 is a schematic view showing the relationship between the adjustable range of the fixing temperature and the adjustable glossiness range.

Graphs G1 and G2 of changes of glossiness [%] to fixing temperature [° C.] in the fixing device 100 (refer to FIG. 5) are schematically shown in FIG. 10. The fixing temperature is the temperature of the fixing belt 112 within the fixing nip part NF. In the graph G1, the surface pressure of the fixing nip part NF (refer to FIG. 5) is set to be low, and the curvature radius R1 (refer to FIG. 7) of the pad member 114 becomes equal to or more than 7 [mm]. On the other hand, in the graph G2, the surface pressure of the fixing nip part NF is set to be higher than the surface pressure in the graph G1, and the curvature radius R1 of the pad member 114 becomes 6 [mm]. In addition, FIG. 10 shows that the fixing temperature is set to T1<T2<T3<T4 and the glossiness is set to K1<K2<K3. The minimum glossiness that is required in a toner image after fixing is defined as K1.

As shown in FIG. 10, in the graph G1 where the surface pressure of the fixing nip part NF is low, a fixing temperature required to obtain the glossiness K1 becomes to T2 that is higher than that in the graph G2. Additionally, in the graph G1, the curvature radius R1 becomes equal to or more than 7 [mm]. Thus, the peelability of the recording paper P is poor, and a temperature rise only to the fixing temperature T3 (equivalent to about glossiness K2) may not be made. That is, since an adjustable temperature range ΔT2 (=T3−T2) becomes narrow on the conditions of the graph G1 where the surface pressure of the fixing nip part NF is low and the curvature radius R1 of the pad member 114 is large, an adjustable glossiness range ΔK2 (=K2−K1) also becomes narrow.

On the other hand, in the graph G2 where the surface pressure is high, a fixing temperature required to obtain the glossiness K1 becomes T1 that is lower than that in the graph G1. For this reason, an adjustable temperature range ΔT1 (=T3−T1) that becomes wider than that in the graph G1, and an adjustable glossiness range ΔK1 (=K3−K1) also becomes wide. Moreover, since the curvature radius R1 is 6 [mm] on the setting conditions of the graph G2, the peelability of the recording paper P is excellent, and a temperature rise to the fixing temperature T4 (equivalent to about glossiness K4) is allowed. That is, it may be seen that, since the upper limit of the fixing temperature becomes high and the lower limit falls, on the conditions of the graph G2 where the surface pressure of the fixing nip part NF is high and the curvature radius R1 of the pad member 114 is set to 6 [mm], the adjustable temperature range becomes wide as ΔT1+ΔT3 (=T4−T1) and the adjustable glossiness range becomes wide as ΔK1+ΔK3 (=K4−K1).

Setting of Respective Fixing Parameters

The results in a case where the minimum fixing temperature is evaluated when heating time (time for which the recording paper P is required to pass), maximum surface pressure (hereinafter referred to as maximum pressure), and fixing nip width W1 in the fixing nip part NF, are changed on the six-way conditions are shown in Table 1. In addition, the minimum fixing temperature is a temperature where poor fixing (a state where a portion of the toner T is no longer fixed on the recording paper P) occurs if the minimum fixing temperature becomes a temperature lower than itself. Additionally, in the evaluation results in Table 1, O shows that the minimum fixing temperature becomes equal to or lower than 160 [° C.], and X shows that that the minimum fixing temperature exceeds 160 [° C.].

As shown in Table 1, it is confirmed that, when the heating time is equal to or more than 20 [msec], the maximum pressure is equal to or more than $2.9\times10^5$ [Pa], and the fixing nip width is equal to or more than 10 [mm], the minimum fixing temperature becomes 160 [° C.] or lower and the fixing lower limit of toner T to the recording paper P becomes wide.

On the other than, the maximum fixing temperature is a temperature where poor fixing (a state where a portion of the toner T in an excessive melting state remains in the fixing belt 112) occurs if the maximum fixing temperature becomes a temperature higher than itself. Here, when the maximum fixing temperature is checked while changing the curvature radius R1 of the pad member 114, it is confirmed that, although the maximum fixing temperature becomes 180 [° C.] when the curvature radius R1 is equal to or less than 6 [mm], the maximum fixing temperature becomes equal to or lower than 170 [° C.] (refer to FIG. 11 to be described below) if the curvature radius R1 becomes larger than 6 [mm]. That is, it is confirmed that the curvature radius R1 preferably becomes equal to or less than 6 [mm] in order to increase the setting temperature range of the fixing belt 112.

Figure 11:
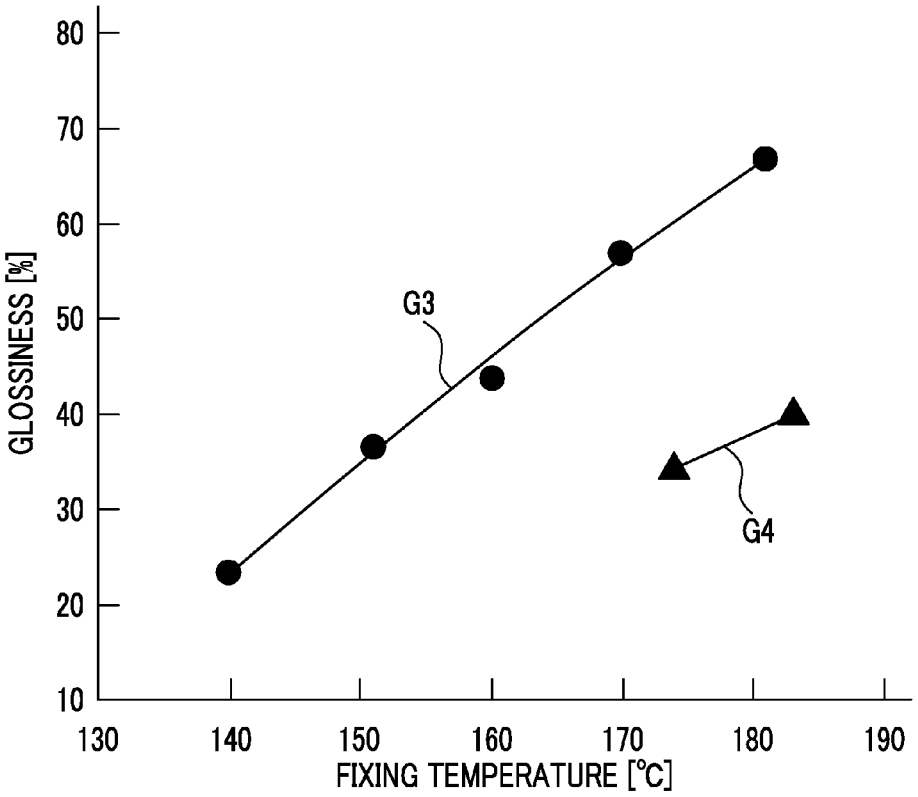
FIG. 11 is a graph showing the relationship between the adjustable range of the fixing temperature and the adjustable glossiness range when Condition 1 and Condition 6 are set in the fixing device related to the first exemplary embodiment.

FIG. 11 shows a graph G3 of glossiness to fixing temperature when fixing is performed with the setting of Condition 1 in Table 1 and the setting of the curvature radius R1 of 6 [mm], and a graph G4 of glossiness to fixing temperature when fixing is performed with the setting of Condition 6 in Table 1 and the setting of the curvature radius R1 of 7 [mm]. As apparent from the graphs G3 and G4, it is confirmed that the setting range of the fixing temperature becomes wide and the adjustable glossiness range becomes wide, on Condition 1 where the heating time is equal to or more than 20 [msec], the maximum pressure is equal to or more than $2.9\times10^5$ [Pa], and the fixing nip width is equal to or more than 10 [mm]. Additionally, it is confirmed that the curvature radius R1 is preferably set to 6 [mm] or less.

As described above, in the present exemplary embodiment, the toner T in which the particle diameter is equal to or less than 4.5 [μm] and the softening point that is an example of viscoelastic characteristics is 100 [° C.] or higher and 125 [° C.] or lower, and the fixing device 100 in which the maximum pressure is equal to or more than $2.9\times10^5$ [Pa], the width of the fixing nip part NF is equal to or more than 10 [mm], and the heating time of the toner T in the fixing nip part NF is equal to or more than 20 [msec] are combined. Thus, the glossiness is adjusted in a wide range simply by the temperature control of the fixing belt 112. That is, the adjustable range of the gloss (glossiness) of a toner image after fixing to the temperature change of the fixing belt 112 when the toner T with a particle diameter of 4.5 [μm] or less is fixed is kept from becoming narrow.

Additionally, in the fixing device 100 of the present exemplary embodiment, the curvature radius R1 of the pad member 114 is specified. Thus, the peelability of the recording

TABLE 1

| Fixing Condition | Condition 1 | Condition 2 | Condition 3 | Condition 4 | Condition 5 | Condition 6 |
|---|---|---|---|---|---|---|
| Heating Time | 60 msec (○) | 20 msec (○) | 18 msec (X) | 20 msec (○) | 20 msec (○) | 21 msec (○) |
| Maximum Pressure | $3.9\times10^5$ Pa (○) | $2.9\times10^5$ Pa (○) | $2.9\times10^5$ Pa (○) | $2.5\times10^5$ Pa (X) | $2.9\times10^5$ Pa (○) | $2.5\times10^5$ Pa (X) |
| Fixing Nip Width | 27 mm (○) | 10 mm (○) | 10 mm (○) | 10 mm (○) | 9.5 mm (X) | 9.5 mm (X) |
| Evaluation Results | ○ | ○ | X | X | X | X |

paper P from the fixing belt 112 increases as compared to a configuration in which the curvature radius R1 is not specified.

Moreover, in the image forming apparatus 10 of the present exemplary embodiment, the gloss of a toner image is changed simply by changing the temperature of the fixing belt 112 in the fixing device 100. Thus, control of the gloss of the toner image is simply performed.

Second Exemplary Embodiment

Next, an example of a fixing device and an image forming apparatus related to a second exemplary embodiment of the invention will be described. In addition, the members and parts that are basically the same as the aforementioned first exemplary embodiment are designated by the same reference numerals as the first exemplary embodiment, and the description thereof is omitted.

Configuration of Main Parts

Figure 12:
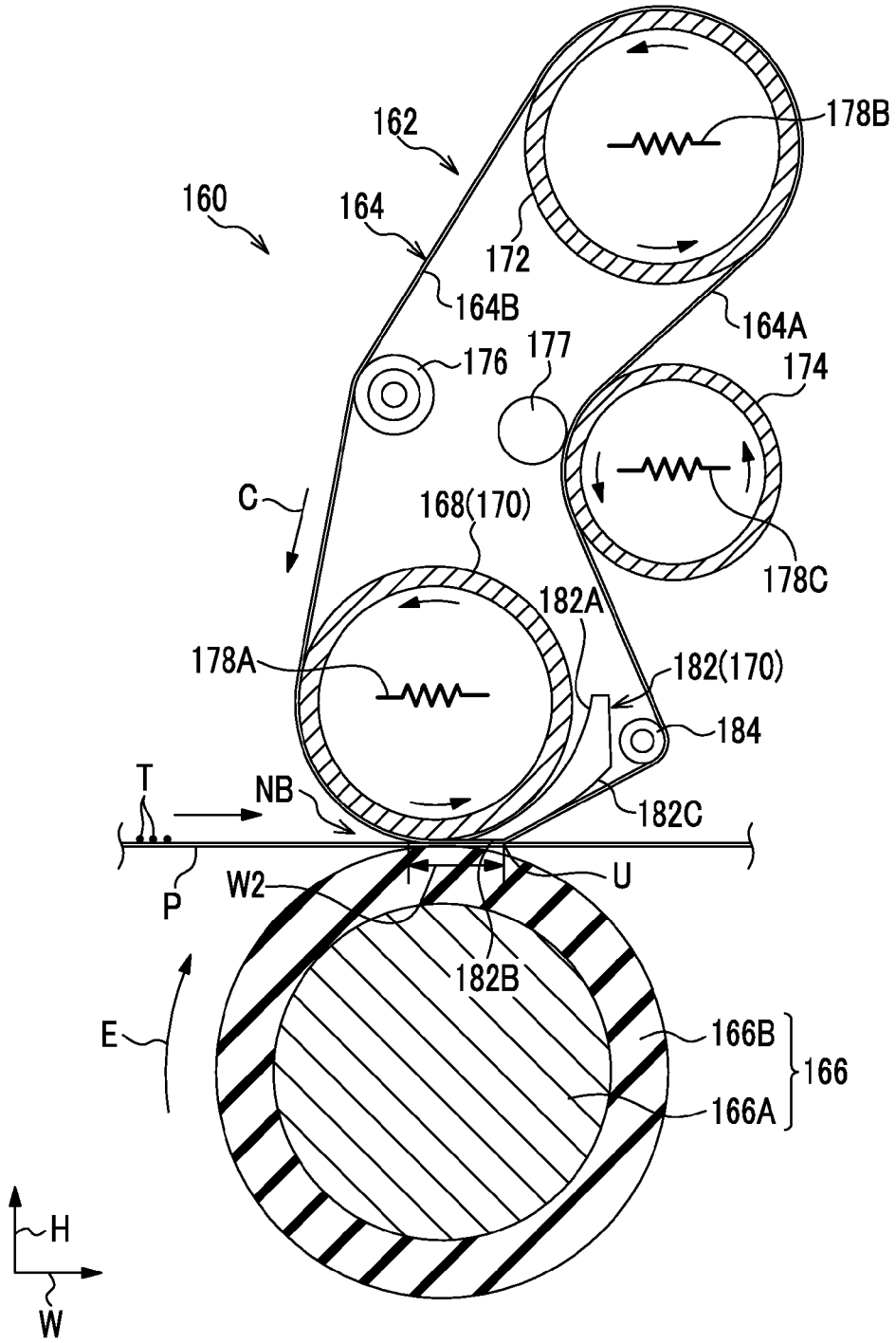
FIG. 12 is a schematic view showing the configuration of a fixing device related to a second exemplary embodiment.

A fixing device 160 related to the second exemplary embodiment is shown in FIG. 12. The fixing device 160 is provided instead of the fixing device 100 (refer to FIG. 1) in the image forming apparatus 10 (refer to FIG. 1) of the first exemplary embodiment.

Additionally, the fixing device 160 is configured to have a fixing belt module 162 including a fixing belt 164 as an example of a fixing rotary body to be described below, and a pressurizing roll 166 as an example of a pressurizing unit that is arranged so as to be pressed against the fixing belt module 162. A fixing nip part NB as an example of a contact part where the fixing belt 164 and the pressurizing roll 166 come into contact with each other is formed between the fixing belt 164 and the pressurizing roll 166. When the recording paper P passes through the fixing nip part NB, toner images (toner T) are fixed on the recording paper P as the recording paper P is pressurized and heated by the pressurizing roll 166 and the fixing belt 164.

The fixing belt module 162 has an endless fixing belt 164 that circulates, heats toner images while transporting the recording paper P, and fixes the toner images on the recording paper P, a supporting member 170 that receives the pressurizing force of the pressurizing roll 166 at a position corresponding the to fixing nip part NB inside the fixing belt 164, and supports the fixing belt 164, and an internal heating roll 172 that is arranged opposite to the fixing nip part NB inside the fixing belt 164 and has the fixing belt 164 wound therearound.

Additionally, although the illustration of the fixing belt 164 is omitted, as an example, the fixing belt is configured so that an elastic layer made of silicone rubber is formed on a base material made of polyimide, and a fluororesin-based release layer is formed on the elastic layer.

The supporting member 170 has a fixing roll 168 as an example of a rotating member, and a peeling pad 182 as an example of a peeling member. In addition, although the sliding sheet 118 (refer to FIG. 13) is provided between the fixing belt 164 and the peeling pad 182, illustration thereof is omitted in FIG. 12.

The fixing belt 164 is arranged on the upstream side in the transporting direction of the recording paper P, has the fixing belt 164 wound therearound, and is rotated by the rotative force of a motor (not shown) so that its axial direction is aligned with the fixing roll 168. A supporting roll 184 around which the fixing belt 164 is wound is provided on the downstream side of the fixing nip part NB.

The peeling pad 182 is arranged on the downstream side in the transporting direction of the recording paper P with respect to the fixing roll 168, and is provided so that the fixing belt 164 is deformed and the recording paper P is peeled from the fixing belt 164. Additionally, the peeling pad 182 may be made of any of metal and resin. However, in the present exemplary embodiment, as an example, the peeling pad is a block-shaped member having an axial length corresponding to the fixing roll 168, and is made of metal. In addition, a high-hardness synthetic resin like a liquid crystal polymer may be used as an example of this resin.

The cross-sectional shape of the peeling pad 182 is configured to include a curved internal surface 182A that faces the fixing roll 168, a pressing surface 182B that presses the fixing belt 164 toward the pressurizing roll 166, and an external surface 182C that has an angle determined with respect to the pressing surface 182B and bends the fixing belt 164. In detail, an angled portion U constituted by the pressing surface 182B and the external surface 182C bends the fixing belt 164 pressed against the angled portion U by the pressurizing roll 166. When the tip of the recording paper P passes by the angled portion U, the tip of the recording paper P is peeled from the fixing belt 164.

Figure 13:
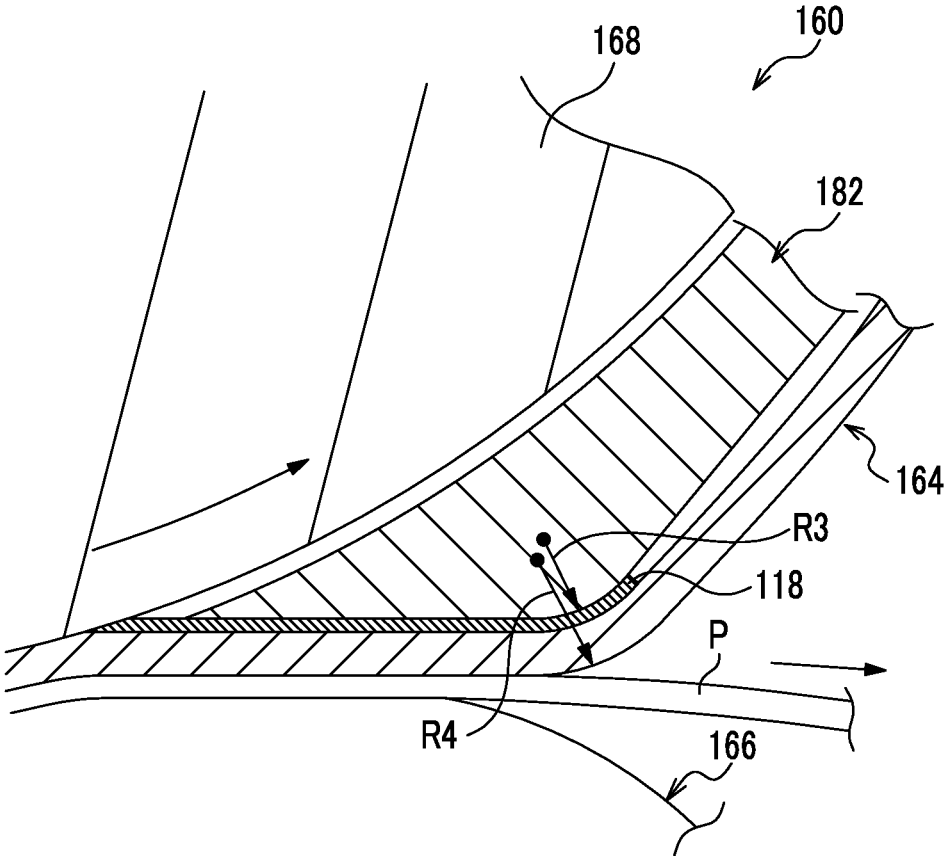
FIG. 13 is a schematic view showing the curvature radius of a pad member and a fixing belt on a fixing nip part outlet side related to the second exemplary embodiment.

Here, as shown in FIG. 13, as for the peeling pad 182, the curvature radius R3 of a part (a part that comes into contact with the fixing belt 164) around which the fixing belt 164 is wound on the downstream side in the transporting direction of the recording paper P is set to 6 [mm] or less, and becomes 6 [mm] as an example. In addition, the dimensional tolerance of the curvature radius R3 is set to ±500 [μm]. The curvature radius R4 of the fixing belt 164 at a downstream end portion of the fixing nip part NB becomes equal to or less than 7 [mm] as an example. The dimensional tolerance of the curvature radius R4 is set to ±500 [μm]. In addition, the thickness of the sliding sheet 118 becomes 100 [μm] or more and 300 [μm] or less, and the thickness of the fixing belt 112 becomes 400 [μm] or more and 450 [μm] or less.

As shown in FIG. 12, the pressurizing roll 166 is configured, as an example, so that an elastic body layer 166B made of silicone rubber is coated on the outer periphery of a columnar roll body 166A made of aluminum. Although illustration is omitted, a release layer whose outer peripheral surface is made of fluororesin or the like of a film thickness of 100 μm is formed on the outer periphery of the elastic body layer 166B. The pressurizing roll 166 is adapted to rotate in a following manner as the fixing roll 168 is driven.

Additionally, the fixing device 160 includes an external heating roll 174 that is arranged on the outer peripheral side of the fixing belt 164 and specifies a circulating path, and a supporting roll 176 that is wound around the inner peripheral surface of the fixing belt 164 from the internal heating roll 172 to the fixing roll 168. In addition, in the present exemplary embodiment, the facing roll 177 that is arranged to face the external heating roll 174 across the fixing belt 164 is provided inside the fixing belt 164.

The internal heating roll 172 serves also as a steering roll that performs meandering adjustment of the fixing belt 164. Additionally, plural halogen lamps 178A, 178B, and 178C as examples of heating units are provided inside the fixing roll 168, the internal heating roll 172, and the external heating roll 174. The fixing roll 168 and the internal heating roll 172 are configured to come into contact with the inner peripheral surface 164B of the fixing belt 164 to heat the fixing belt 164 from the inside, and the external heating roll 174 is configured to come contact with the outer peripheral surface 164A of the fixing belt 164 to heat the fixing belt 164 from the outside.

Here, in the fixing device 160, the maximum pressure in the fixing nip part NB is set to $2.9\times10^5$ [Pa] or more. In the present exemplary embodiment, as an example, the maximum pressure is set to $3.0\times10^5$ [Pa]. In addition, the maximum pressure is measured using a tactile sensor system made by Nitta, Inc.

Additionally, in the fixing device 160, the width W2 of the fixing nip part NB in a movement direction of the recording paper P is set to 10 [mm] or more. In the present exemplary embodiment, as an example, the width W2 is set to 10 [mm]. Moreover, in the fixing device 160, the heating time of the toner T in the fixing nip part NB is set to 20 [msec] or more. In the present exemplary embodiment, as an example, the heating time is set to 20 [msec].

Operation

Next, the operation of the second exemplary embodiment will be described.

Basic Operation of Fixing Device

As shown in FIG. 12, the recording paper P on which the toner images are transferred in the transfer nip NT (refer to FIG. 1) is introduced into the fixing nip part NB by the intermediate transporting part 58 (refer to FIG. 1).

The fixing roll 168 is rotated under the driving force from a driving sources (not shown), such as a motor. Additionally, the fixing belt 164 circulates in the direction of arrow C so as to follow the rotation of the fixing roll 168. Moreover, the pressurizing roll 166 rotates in the direction of arrow E so as to follow the rotation of the fixing belt 164.

Subsequently, the recording paper P introduced into the fixing nip part NB is transported in a downstream direction by the circulating fixing belt 164 and pressurizing roll 166. Then, the recording paper P receives pressurizing and heating actions from the fixing belt 164 and the pressurizing roll 166 in the fixing nip part NB. As a result, the toner images are fixed on the recording paper P. In addition, the heating to the recording paper P is performed by the fixing belt 164 heated by the fixing roll 168, the internal heating roll 172, and the external heating roll 174.

Subsequently, the fixing belt 164 passed through the fixing nip part NB is pressed against and bent by the angled portion U constituted by the pressing surface 182B and external surface 182C of the peeling pad 182. Then, when the tip of the recording paper P passes by the angled portion U, the recording paper P is peeled from the fixing belt 164 by the so-called "stiffness".

Setting of Respective Fixing Parameters

The results in a case where the minimum fixing temperature is evaluated when heating time (time for which the recording paper P is required to pass), maximum surface pressure (hereinafter referred to as maximum pressure), and fixing nip width W2 in the fixing nip part NB, are changed on the six-way conditions are shown in Table 2. In addition, the minimum fixing temperature and the maximum fixing temperature are as already described. Additionally, in the evaluation results in Table 2, O shows that the minimum fixing temperature becomes equal to or lower than 160 [° C.], and X shows that that the minimum fixing temperature exceeds 160 [° C.].

As shown in Table 2, it is confirmed that, when the heating time is equal to or more than 20 [msec], the maximum pressure is equal to or more than is $2.9\times10^5$ [Pa], and the fixing nip width is equal to or more than 10 [mm], the minimum fixing temperature becomes 160 [° C.] or lower and the fixing lower limit of toner T to the recording paper P becomes wide.

On the other hand, when the maximum fixing temperature is checked while changing the curvature radius R3 of the peeling pad 182, it is confirmed that, although the maximum fixing temperature becomes 180 [° C.] when the curvature radius R3 is equal to or less than 6 [mm], the maximum fixing temperature becomes equal to or lower than 170 [° C.] if the curvature radius R3 becomes larger than 6 [mm]. That is, it is confirmed that the curvature radius R3 preferably becomes equal to or less than 6 [mm] in order to increase the setting temperature range of the fixing belt 112.

As described above, in the present exemplary embodiment, the toner T in which the particle diameter is equal to or less than 4.5 [μm] and the softening point that is an example of viscoelastic characteristics is 100 [° C.] or higher and 125 [° C.] or lower, and the fixing device 160 in which the maximum pressure is equal to or more than $2.9\times10^5$ [Pa], the width of the fixing nip part NB is equal to or more than 10 [mm], and the heating time of the toner T in the fixing nip part NB is equal to or more than 20 [msec] are combined. Thus, the controllable range of the glossiness becomes wide simply by the temperature control of the fixing belt 164. That is, the adjustable range of the gloss (glossiness) of a toner image after fixing to the temperature change of the fixing belt 164 when the toner T with a particle diameter of 4.5 [μm] or less is fixed is kept from becoming narrow.

Additionally, in the fixing device 160 of the present exemplary embodiment, the curvature radius R3 of the peeling pad 182 is specified. Thus, the peelability of the recording paper P from the fixing belt 164 increases as compared to a configuration in which the curvature radius R3 is not specified.

Moreover, in the image forming apparatus 10 of the present exemplary embodiment, the gloss of a toner image is changed simply by changing the temperature of the fixing belt 164 in the fixing device 160. Thus, control of the gloss of the toner image is simply performed.

In addition, the invention is not limited to the above exemplary embodiments.

The toner T may have a particle diameter of 4.5 [μm] or less, and is not limited to one having a particle diameter of 3.8 [μm].

In the fixing devices 100 or 160, the external roll 104 or the external heating roll 174 may not be provided. Additionally, in the fixing devices 100 and 160, a configuration in which the sliding sheet 118 is not provided may be adopted.

The pressurizing unit is not limited to one that rotates like the pressurizing roll 106 or 166, and may be a fixed pad member.

TABLE 2

| Fixing Condition | Condition 1 | Condition 2 | Condition 3 | Condition 4 | Condition 5 | Condition 6 |
|---|---|---|---|---|---|---|
| Heating Time | 60 msec (○) | 20 msec (○) | 15 msec (X) | 20 msec (○) | 20 msec (○) | 25 msec (○) |
| Maximum Pressure | $3.9\times10^5$ Pa (○) | $2.9\times10^5$ Pa (○) | $2.9\times10^5$ Pa (○) | $2.0\times10^5$ Pa (X) | $2.9\times10^5$ Pa (○) | $2.0\times10^5$ Pa (X) |
| Fixing Nip Width | 27 mm (○) | 10 mm (○) | 10 mm (○) | 10 mm (○) | 9.0 mm (X) | 9.0 mm (X) |
| Evaluation Results | ○ | ○ | X | X | X | X |

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A fixing device comprising:

a fixing rotary body that heats and pressurizes, together with a recording medium, toner having particle diameter of 4.5 μm or less and a softening point of 100° C. or higher and 125° C. or lower to fix the toner on the recording medium;

a heating unit that heats the fixing rotary body;

a pressurizing unit that sandwiches and pressurizes the toner and the recording medium in a first contact part formed by the fixing rotary body;

an external heating roll that contacts an outside of the fixing rotary body; an internal roll that sandwiches the fixing rotary body in a second contact part formed by the external heating roll; and an elastic member that presses the internal roll against the external heating roll wherein:

the first contact part is not parallel to a horizontal radius of the pressurizing unit, the maximum pressure in the first contact part is equal to or more than $2.9\times10^5$ Pa, the width of the first contact part in a movement direction of the recording medium is equal to or more than 10 mm, the heating time of the toner in the first contact part is equal to or more than 20 msec, and a lowest part of the internal roll is above, in a height direction of the apparatus, a lowest portion of the external heating roll.

2. The fixing device according to claim 1, wherein the fixing rotary body is an endless belt, a supporting member that receives the pressurizing force of the pressurizing unit and supports the fixing rotary body is provided at a position corresponding to the first contact part inside the fixing rotary body, and a part of the supporting member, which is located on the downstream side in a transporting direction of the recording medium and has the fixing rotary body wound therearound, has a curvature radius of 6 mm or less.

3. An image forming apparatus comprising:

an image forming section that develops a latent image of an image holding member holding the latent image with toner to form a toner image, and transfers the toner image to a recording medium to form an image; and the fixing device according to claim 1 that fixes the toner image formed in the image forming section on a recording medium.

4. An image forming apparatus comprising:

an image forming section that develops a latent image of an image holding member holding the latent image with toner to form a toner image, and transfers the toner image to a recording medium to form an image; and the fixing device according to claim 2 that fixes the toner image formed in the image forming section on a recording medium.

* * * * *